US007674062B2

(12) United States Patent
Horn

(10) Patent No.: US 7,674,062 B2
(45) Date of Patent: Mar. 9, 2010

(54) RING BINDER MECHANISM

(76) Inventor: Hans Johann Horn, Junkerngasse 53, CH-3011 Bern (CH)

( * ) Notice: Subject to any disclaimer, the term of this patent is extended or adjusted under 35 U.S.C. 154(b) by 485 days.

(21) Appl. No.: 11/401,607

(22) Filed: Apr. 11, 2006

(65) Prior Publication Data

US 2006/0228164 A1 Oct. 12, 2006

(30) Foreign Application Priority Data

Apr. 12, 2005 (DE) ..... 10 2005 016 900
Jan. 27, 2006 (DE) ..... 10 2006 004 113

(51) Int. Cl.
*B42F 13/20* (2006.01)
*B42F 3/04* (2006.01)

(52) U.S. Cl. ..... 402/31; 402/35; 402/36; 402/38

(58) Field of Classification Search ..... 402/19–20, 402/23, 26, 31–42, 70, 73, 76, 77
See application file for complete search history.

(56) References Cited

U.S. PATENT DOCUMENTS

| | | | | |
|---|---|---|---|---|
| 849,973 | A | 4/1907 | Buchan | |
| 974,831 | A | 11/1910 | Scherzinger | |
| 1,020,561 | A | 3/1912 | Krumming | |
| 1,163,179 | A | 12/1915 | Schade, Jr. | |
| 1,369,309 | A | 2/1921 | Trussell | |
| 1,724,407 | A | 8/1929 | Lotter | |
| 1,787,957 | A | 1/1931 | Schade | |
| 1,887,530 | A | 11/1932 | Trussell | |
| 1,996,463 | A | 4/1935 | Dawson et al. | |
| 2,236,321 | A * | 3/1941 | Ostrander | 402/33 |
| 2,512,415 | A | 6/1950 | Buenger et al. | |
| 3,074,744 | A | 1/1963 | Pucci et al. | |

(Continued)

FOREIGN PATENT DOCUMENTS

| | | |
|---|---|---|
| EP | 05011914.8 | 8/2005 |

(Continued)

*Primary Examiner*—Dana Ross
*Assistant Examiner*—Kyle Grabowski
(74) *Attorney, Agent, or Firm*—Stinson Morrison Hecker LLP

(57) ABSTRACT

The invention relates to a ring binder mechanism comprising a housing (10) for receiving two carrier rails (20), wherein the carrier rails are positioned adjacent one another with at least a portion of their inner longitudinal edges (23) facing each other to form a linkage axis (22) and at least a portion of their outer longitudinal edges (24) engaging the housing (10). The carrier rails (20) have at least two half-rings (16) rigidly connected with the carrier rails, which together form a ring (14). The carrier rails (20) are limitedly pivotable relative to each other about the linkage axis (22), taking along the half-rings (16), between an open position and a closed position. A locking rod (31) having at least one locking element (32) is movable parallel to the linkage axis (22) relative to the housing (10) and the carrier rails (20) via an actuating element (18). The locking rod is provided adjacent the bottom or exterior surface of the carrier rails (i.e. the surface facing away from the housing). The locking element (32) engages a portion of the carrier rails and blocks the pivot path of the carrier rails (20) in the closed position. Abutments or bearings are provided on the carrier rails (20) or on the housing flanks (28) for receiving locking forces, against which the locking element (32) is supported in the closed position.

6 Claims, 29 Drawing Sheets

U.S. PATENT DOCUMENTS

| | | | | |
|---|---|---|---|---|
| 3,132,649 | A | 5/1964 | Gits | |
| 3,201,145 | A | 8/1965 | Libby | |
| 3,572,957 | A | 3/1971 | Strassberg | |
| 3,771,890 | A | 11/1973 | Notto | |
| 3,837,680 | A | 9/1974 | Cimini | |
| 3,968,546 | A | 7/1976 | Seaborn et al. | |
| 3,993,374 | A | 11/1976 | Schudy et al. | |
| 4,114,240 | A | 9/1978 | Nackenson | |
| 4,130,368 | A | 12/1978 | Jacoby et al. | |
| 4,295,747 | A | 10/1981 | Errichiello | |
| 4,566,817 | A | 1/1986 | Barrett, Jr. | |
| 5,108,212 | A | 4/1992 | Lee | |
| 5,273,319 | A | 12/1993 | Lee | |
| 5,672,022 | A | 9/1997 | Lin | |
| 5,695,295 | A | 12/1997 | Ayele et al. | |
| 5,816,729 | A | 10/1998 | Whaley | |
| 6,213,668 | B1 | 4/2001 | Brown et al. | |
| 6,270,279 | B1 | 8/2001 | Whaley | |
| 6,276,862 | B1 | 8/2001 | Snyder et al. | |
| 6,364,559 | B2 | 4/2002 | Brown et al. | |
| 6,840,695 | B2 | 1/2005 | Horn | |
| 2002/0122687 | A1 | 9/2002 | Horn | |
| 2003/0103797 | A1 | 6/2003 | Cheng | |
| 2003/0103798 | A1 | 6/2003 | Cheng et al. | |
| 2005/0013654 | A1 | 1/2005 | Cheng et al. | |
| 2005/0201817 | A1 | 9/2005 | Cheng | |
| 2005/0201818 | A1 | 9/2005 | Cheng | |
| 2005/0201819 | A1 | 9/2005 | Cheng | |
| 2005/0201820 | A1 | 9/2005 | Ng et al. | |
| 2005/0207826 | A1* | 9/2005 | Cheng et al. | 402/31 |
| 2005/0214064 | A1 | 9/2005 | Ng et al. | |
| 2005/0232689 | A1 | 10/2005 | Cheng | |
| 2006/0056906 | A1 | 3/2006 | Horn | |
| 2006/0153629 | A1* | 7/2006 | Cheng | 402/38 |
| 2006/0251468 | A1* | 11/2006 | Cheng | 402/38 |
| 2007/0160415 | A1* | 7/2007 | To et al. | 402/19 |
| 2007/0160416 | A1* | 7/2007 | Cheng | 402/19 |

FOREIGN PATENT DOCUMENTS

| | | |
|---|---|---|
| EP | 05250415.6 | 9/2005 |
| GB | 9519740.6 | 3/1995 |
| JP | 01299095 | 1/1989 |

* cited by examiner 52
54
52
54
32

31
52
52
56
54
32
38
56
54

34

31
52
51
38
54
51
38
32
42
18
40

14
16
18
20
31
32"
64
66
68

RING BINDER MECHANISM

CROSS-REFERENCE TO RELATED APPLICATIONS

This application is based on German Serial No. 10 2006 004 113.5 filed on Jan. 27, 2006, which claims priority to German Serial No. 10 2005 016 900.7 filed on Apr. 12, 2005, both of which are hereby incorporated by reference and to which priority is claimed.

STATEMENT REGARDING FEDERALLY SPONSORED RESEARCH OR DEVELOPMENT

Not applicable.

BACKGROUND OF THE INVENTION

1. Field of the Invention

The invention concerns a ring binder mechanism with a housing having a C or U-shaped cross section with spring elastic spreadable flanks for two carrier rails, which on their longitudinal edges facing each other (inward facing) lie against each other to form a linkage or articulation axis and with their longitudinal edges facing away from each other (outward facing) engage in bearing grooves of the housing flanks, and with at least two half-rings rigidly connected with the carrier rails in a defined longitudinal spacing, preferably extending through openings in the housing wall and pair-wise cooperating to form a ring, wherein the carrier rails and the linkage axis, taking along the half-rings, are limitedly pivotable relative to each other between an open position and a closed position under the influence of, or overcoming the influence of, a spring force produced by bending open the housing flanks, and with at least one locking element movable relative to the housing and to the carrier rails, preferably pretensioned in the direction of the closed position under the influence of at least one locking spring, which in the locked position blocks the pivot path of the carrier rails about the linkage axis and is supported against at least one bearing for receiving locking forces and which in the open position unblocks the pivot path of the carrier rails.

2. Description of Related Art

In ring binder mechanisms, it is known to secure the organizing half-rings to carrier rails that are encompassed by a housing of a spring elastic material. The carrier rails are introduced in the housing in such a manner that they can assume two rest positions, an open and a closed position. The housing functions as a spring element, which fixes the half-rings in their open position and in their closed position. In the area of the inner longitudinal edges of the carrier rails there are engaging pieces or locking means, which ensure that the two carrier rails always lie edge-to-edge along these longitudinal edges. Therein the carrier rails have the function of a toggle lever held springingly at the outer edges. In conventional ring binder mechanisms, the opening and closing of the rings occurs directly via the half-rings. In order to achieve sufficient pretension and closure forces, a relatively large spring force is necessary in the area of the housing. The necessary operating forces are correspondingly large. The larger these forces, the larger also the danger of injury occurring upon closure at the points where the ring halves contact. In addition, since the closing forces are realized exclusively elastically, it often occurs that in response to a corresponding force, for example, upon falling onto the floor, the rings open by themselves, so that the stationary located there-between can fall out.

In order to overcome this disadvantage, it is known (U.S. Pat. No. 6,840,695), to secure the rings in their closed position by means of a locking element, which is displaceable relative to the housing and to the carrier rails parallel to the linkage axis via a locking rod and which in the closed position engages in a free space formed between the carrier rails and the housing wall with blockage of the pivot path of the carrier rails, and in the open position frees the pivot path. The half-rings are held in the closed position via a locking element that is held in a pretensioned position acting against the carrier rails, wherein the housing wall lying opposite to the carrier rails functions as a bearing for the locking element and for receiving the reaction forces corresponding to the locking forces.

In this ring binder mechanism, it is unavoidable that large manufacturing tolerances occur between the housing wall and the carrier rails, which must be compensated for by a wedge-shaped locking element. For this reason, the locking elements have relatively steep wedge surfaces, which are detrimental to the establishment of high locking forces between the housing walls and the carrier rails. If in such a case multiple locking elements are provided rigidly upon the locking rod, the tolerance problems are amplified, since additionally the space tolerances between the locking elements enter into the equation, which have, as a consequence, uneven locking forces and therewith also uneven closing forces at the ring pairs. In order to avoid such tolerance problems, individual locking springs have been assigned to each locking element in some ring binder mechanisms, which leads to a multiplication of manufacturing costs.

BRIEF SUMMARY OF THE INVENTION

Beginning therewith, it is the task of the present invention to improve the known ring binder mechanisms of the above-described type in such a manner that tolerance problems during the closing process are avoided.

The inventive solution is seen primarily therein, that on the carrier rails or on the housing flanks at least one bearing or abutment is provided for supporting the locking element in the closed position. By the relocation of the locking force receiving bearing, away from the housing wall, towards the area of the carrier rails and/or the housing flanks, tolerance problems, which always occur in the manufacturing of the components, are constructively limited to be so small, that even in the case of use of a locking rod with multiple rigidly provided locking elements, a defined pretension can be achieved on all rings of the ring binder mechanism. Additionally, in the preferred embodiments, the locking elements are provided on a movable or displaceable locking rod positioned along the outer or exterior surface of the carrier rails (i.e. the surface facing away from the housing). Since the locking element and locking rod are not fitted within the interior of the ring binder mechanism between the housing and carrier rails, the cost of assembly is reduced.

According to a first advantageous or alternative embodiment of the invention, the carrier rails have respectively at least one lever arm distanced from the area of the linkage axis towards the side of the locking rod, while the locking rods include two control curves facing opposite sides that respectively face one of the lever arms and respectively an opening segment lying closer to the longitudinal center plane running through the linkage axis and a locking segment distanced further from the longitudinal central plane and forming a locking element. For forming an opening detent there is provided, according to a preferred embodiment of the invention, a detent or locking abutment for the adjacent lever arm, between the opening segment and the locking segment of the control curve.

In order to avoid collisions between adjacent lever arms of the carrier rails during the opening and closing process, it is proposed in accordance with a preferred embodiment of the invention that the lever arms on the two carrier rails and the associated control curves on the locking rods are provided with respective axial offset from each other. In accordance therewith it is advantageous when respectively two adjacent lever arms on the two carrier rails and the associated opening and closing segments on the locking rods in the longitudinal direction of the carrier rails and the locking rods are offset relative to each other. In the simplest case, two lever arms can be provided spaced apart from each other on one of the carrier rails, and, on the other, a third lever arm can be provided approximately centrally between the two previously mentioned lever arms, while the locking rods exhibit a corresponding number of control curves in corresponding locations.

One advantageous embodiment of the invention envisions that the lever arms are in the form of straight plates stamped and bent out of the flat material of the carrier rails, and include a step-like notch or recess area at the engagement height of the locking rod. The greater the lever length of the lever arm in the area of the engagement height, the greater the associated closing forces. A preferred embodiment of the invention envisions that the locking rod is comprised of a flat material strip, on the side longitudinal edges of which the control curve is formed, which lies against respectively one inner edge of the lever arm in the area of the notch or recess. The locking rod is therein preferably drawn against a guide step provided in the area of the notch or recess under the influence of a spring force acting in the direction of the carrier rails.

A further preferred or alternative embodiment of the invention envisions that the locking rod include at least two locking elements spaced apart from each other, with a hook part extending through two openings in the carrier rails along the linkage axis as well as at least two support or abutment plates on the locking rod supporting themselves on the abutments of the carrier rails or the housing flanks, wherein the hook part in the locked position engages behind the two carrier rails on the side opposite the abutment surface. The hook part therein preferably reaches or extends over the area of the linkage axis between the two carrier rails. A preferred embodiment of the invention envisions that the locking element is stamped and bent out of the flat material of the locking rod. The support plates preferably define a wide angle or arc that corresponds to the opposite angle or arc of the carrier rails in the closed position of the half-rings or is somewhat smaller than the opposite angle of the carrier rails. Alternatively the support plates can be bent on their side edges in the direction of the carrier rails.

According to a further preferred or alternative embodiment of the invention the carrier rails include at least two locking elements extending pair-wise respectively with a hook through an opening in the locking rod close to the axis, of which the hook part in the locked position extends behind the opening edge of the locking rod, while the locking rod additionally includes at least two support plates or straps supporting themselves on the abutments or bearings of the carrier rail or the housing flanks. Preferably the locking elements are stamped and bent out of the flat material of the carrier rails, while the support plates define a broad angle or arc with each other or are bent off on their side edges in the direction of the abutment or bearing surfaces.

In different variations of the invention, the carrier rails have at least two support sections pair wise facing each other, which in the closed or locked position border a locking gap for receiving the locking element, and which with locking of the pivot path of the carrier rails is supported on the locking element.

In order to be able to accept or receive as much paper as possible, the ring binders must be provided with large rings. As the content increases so also do the forces acting on the rings, which must be held or maintained in the locked position by the locking forces. An enlargement of the rings and the therewith to be received content thus is accompanied by an expansion of the housing and the carrier rails. This means, that the effective lever arms of the carrier rails are enlarged and thus, with the same bearing or support bearing forces, the locking forces, or, as the case may be, closing moment can be enlarged. In the above-described illustrative embodiments, the ring binder mechanism is constructed substantially symmetrically in the area of the carrier rails. In particular one has, with the until now known solutions, arranged the locking elements axially centrally within the housing. This leads thereto, that for each carrier rail one-half of the width of the housing is available for the lever arm.

In order to be able to produce greater locking moments with the same housing width, it is proposed in accordance with an advantageous or alternative embodiment of the invention, that on one of the carrier rails at least one support strut is provided projecting or extending sideways beyond its articulation axis longitudinal edge to the other carrier rail, and that between the support strut and the other carrier rail in the closed position of the half-rings a locking gap is formed for receiving the locking element advanced in its locking position. Preferably the support strut lies indirectly or directly against the other carrier rail when in the open position of the half-rings and the locking element with closing of the locking gap. A preferred embodiment of the invention envisions that the at least one locking element is provided or formed on a locking rod and provided in the area of the other carrier rail, displaceable parallel to the linkage axis via an actuating element, which can lie slidingly against the adjacent housing flank.

A further preferred embodiment of the invention envisions that the two carrier rails respectively are provided with a support strut extending sideways beyond its articulated linkage side longitudinal edge towards the other carrier rail, and that between the support struts and the respective other carrier rail in the closed position of the half-rings a locking gap is formed for receiving a locking element when advanced in its locking position. The support struts lie preferably indirectly or directly against the respective other carrier rail in the open position of the half-rings and the locking element, thereby closing the locking gap. The locking elements can therein be eccentric or not centered relative to the linkage axis and be provided or formed on a preferably frame-like or U-shaped locking rod displaceable by the actuating element.

Preferably the at least one locking element exhibits a ramp slant or camfer in the sliding direction for the associated support strut. This embodiment is above all suited for a ring binder mechanism, of which the locking rod is advanced in both directions via an actuating element without the support of a closing spring. In order to also be able to exercise a closing process also by pressing against the open ring house, it is however of advantage, when the at least one locking element or its locking rod is pretensioned in the direction of the closed position by means of at least one closing spring. The at least one closing spring can therein be in the form of a pull spring tensioned between the at least one locking element or its locking rod and one of the carrier rails or the housing. In the locking rod, which is preferably comprised of plastic, a pocket-like recess can be provided open towards the exterior carrier rail surface for at least partially receiving the locking spring.

A further preferred embodiment of the invention envisions that the at least one support strut forms a flap or strip formed from the flat material of the associated carrier rail, formed with its root or base near longitudinal edge in the vicinity of the linkage side or linkage, bent out of the carrier rail, which in the area of its root extends through a linkage-side edge-open recess or opening in the other carrier rail. In addition, the locking rod preferably has a one-sided edge open recess or cut, limited by the linkage element, in its open position for receiving the associated support strut.

In all embodiments of the invention the spring force can be provided by multiple springs. A particularly advantageous constructive embodiment of the invention is produced when only one pulled spring is employed acting as the closing spring, of which its locking rod side hooking-in point, with regard to the longitudinal direction, is positioned between the two locking elements and of which the other of its hooking-in points is provided on one of the carrier rails. The locking rod is thereby preferably pulled with a force component of the closing spring in the direction of the carrier rails.

According to a further advantageous or alternative embodiment of the invention there is provided between the actuating element and the locking rod a connecting element of spring elastic or springingly bending material, which renders the actuating element free of play or slack, at least in its closed position. The connecting element can therein be in the form of a piece of wire with at least a connecting shank provided between the actuating element and the locking rod, wherein the connecting shank can exhibit an elastic stretching bending under the influence of the pull force.

A further advantageous or alternative embodiment of the invention envisions that between the actuating element and the locking rod a connecting element is provided, which is in the form of an essentially U-shaped bent piece of wire, of which the shank ends are bent hook-like and are fitted into openings on the locking rod. The openings are slanted diagonally to define guide slots oriented in the direction of displacement of the locking rod, while the shanks of the connecting element are pretensioned spring elastic relative to each other when engaged within the guide slots so as to render the actuating element free of play at least in the closed position.

Additional aspects of the invention, together with the advantages and novel features appurtenant thereto, will be set forth in part in the description that follows, and in part will become apparent to those skilled in the art upon examination of the following, or may be learned from the practice of the invention. The objects and advantages of the invention may be realized and attained by means of the instrumentalities and combinations particularly pointed out in the appended claims.

BRIEF DESCRIPTION OF THE DRAWINGS

In the following the invention will be described in greater detail on the basis of illustrative examples shown in schematic manner in the figures. There is shown FIGS. 1*a*-1*d*. A top view, an end view, a longitudinal side section and a perspective bottom view of a first embodiment of the ring binder mechanism with three rings in closed position.

DETAILED DESCRIPTION OF PREFERRED EMBODIMENT

Figures 12A, 12B:
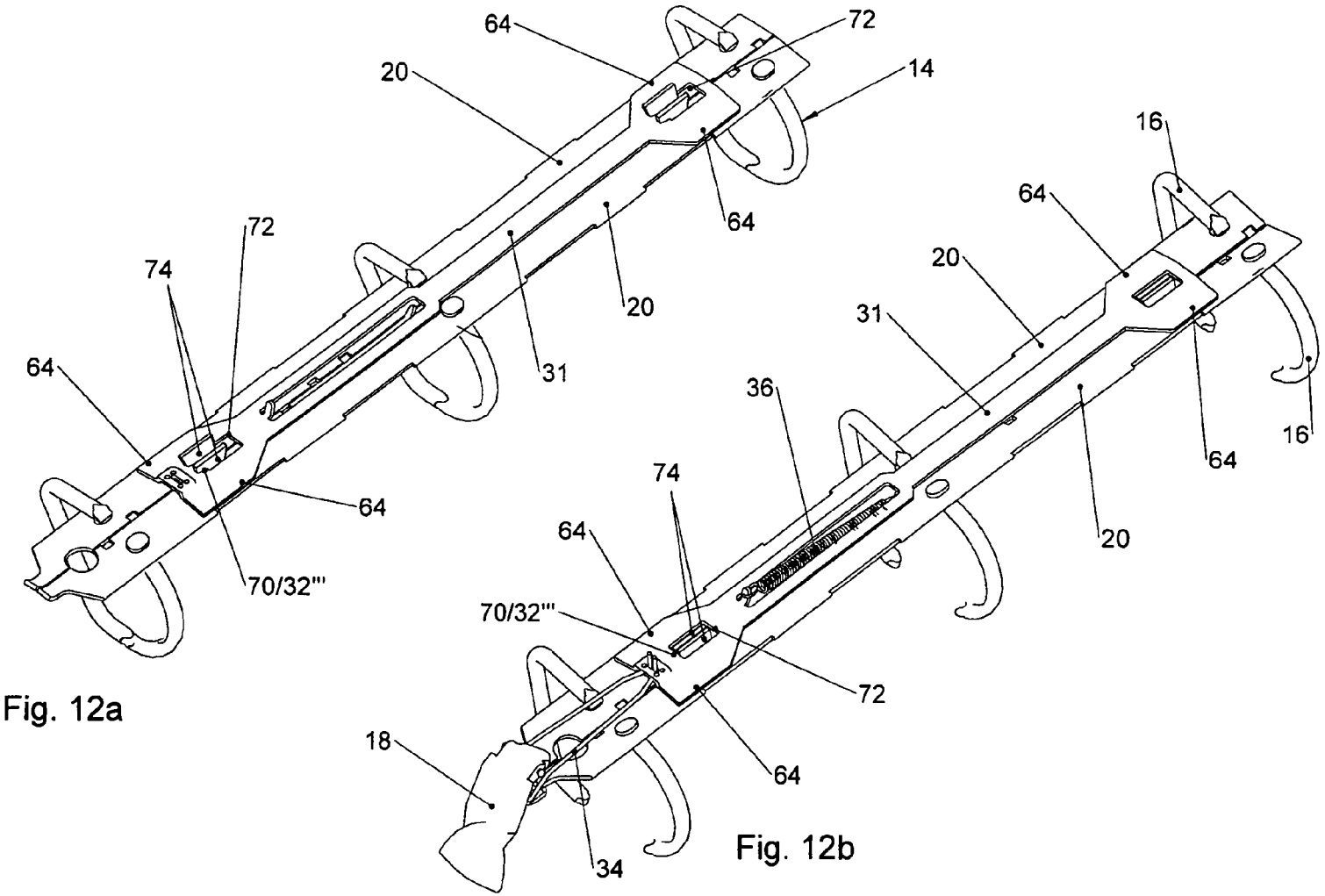
FIGS. 12*a* and 12*b*. A bottom perspective view of a fourth embodiment of a ring binder mechanism in the closed position and in the open position without the housing.

The ring binder mechanism shown in the figures is intended above all for receiving loose hole-punched sheets, for example stationary or printed materials. The ring binder mechanism is comprised essentially of a housing 10, at least two half-rings 16 provided in defined spacing from each other, extending through openings 12 in a housing wall 13 and pair-wise cooperating to form a ring 14, as well as an actuating element 18 in the form of an actuating lever for opening and closing the rings 14. The half-rings 16 are rigidly secured to two carrier rails 20, which lie against each other along inner longitudinal edges 23 to define a linkage axis 22 and with their outer longitudinal edges 24 engaging in bearing channels 26, stamped into the housing flanks 28. The carrier rails 20 are so introduced into the housing 10, such that they can assume two rest positions, an open and a closed position (see, for example, FIGS. 12*a* and 12*b*). The housing 10 functions as a spring element, which fixes the half-rings 16 in their open position and their closed position. In the area of the inner longitudinal edges 23 of the carrier rails 20 there are engaging pieces 30, which insure that the two carrier rails 20 are always blunt or flush against each other with their longitudinal edges. The carrier rails 20 thereby have the function of an elbow lever held under spring tension by the outer edges 24. Therein the carrier rails 20 can be pivoted limitedly relative to each other about the linkage axis 22 between the open position and the closed position, taking along half-rings 16, upon overcoming the spring force produced by the bending apart of the housing flanks 28.

Figure 1C:
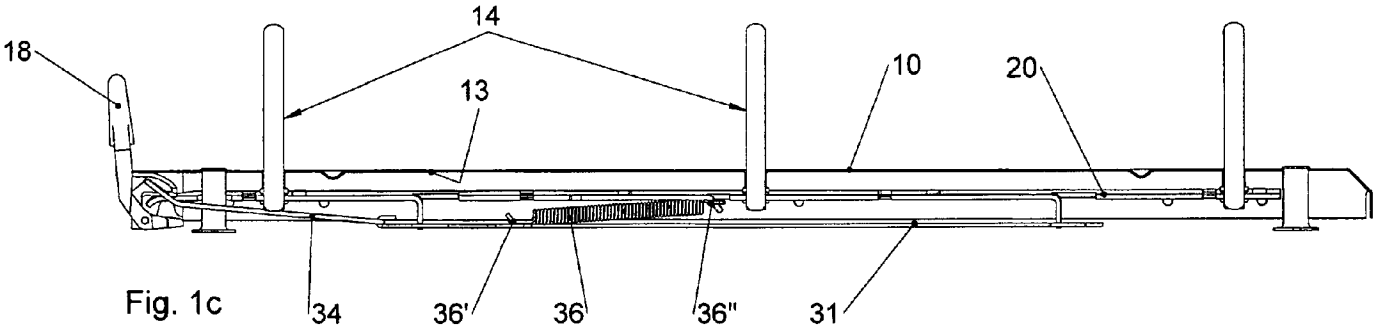
FIG. 1*e*. A perspective bottom view of the mechanism of FIGS. 1*a*-1*d* with the housing removed.
Figure 1A:
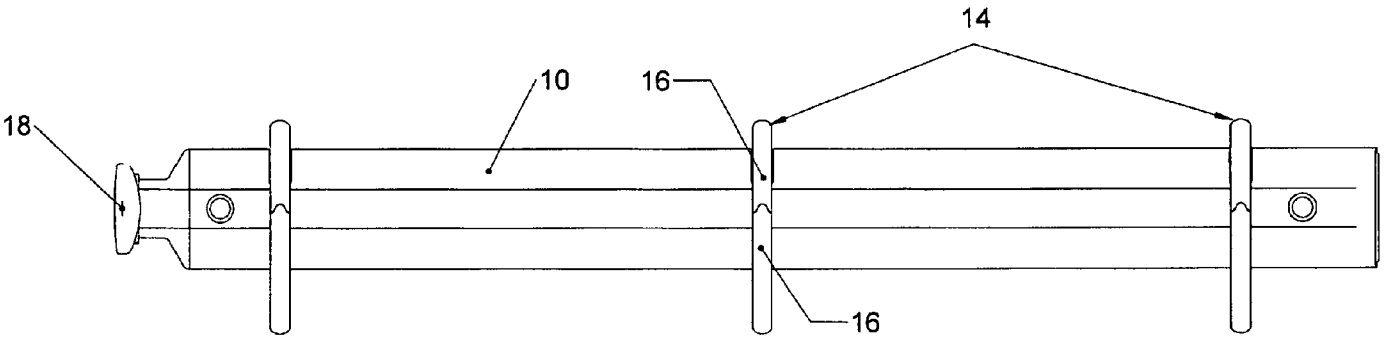
Figure 1B:
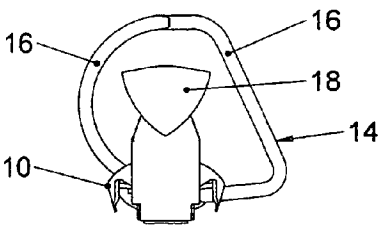
Figures 1D, 1E:
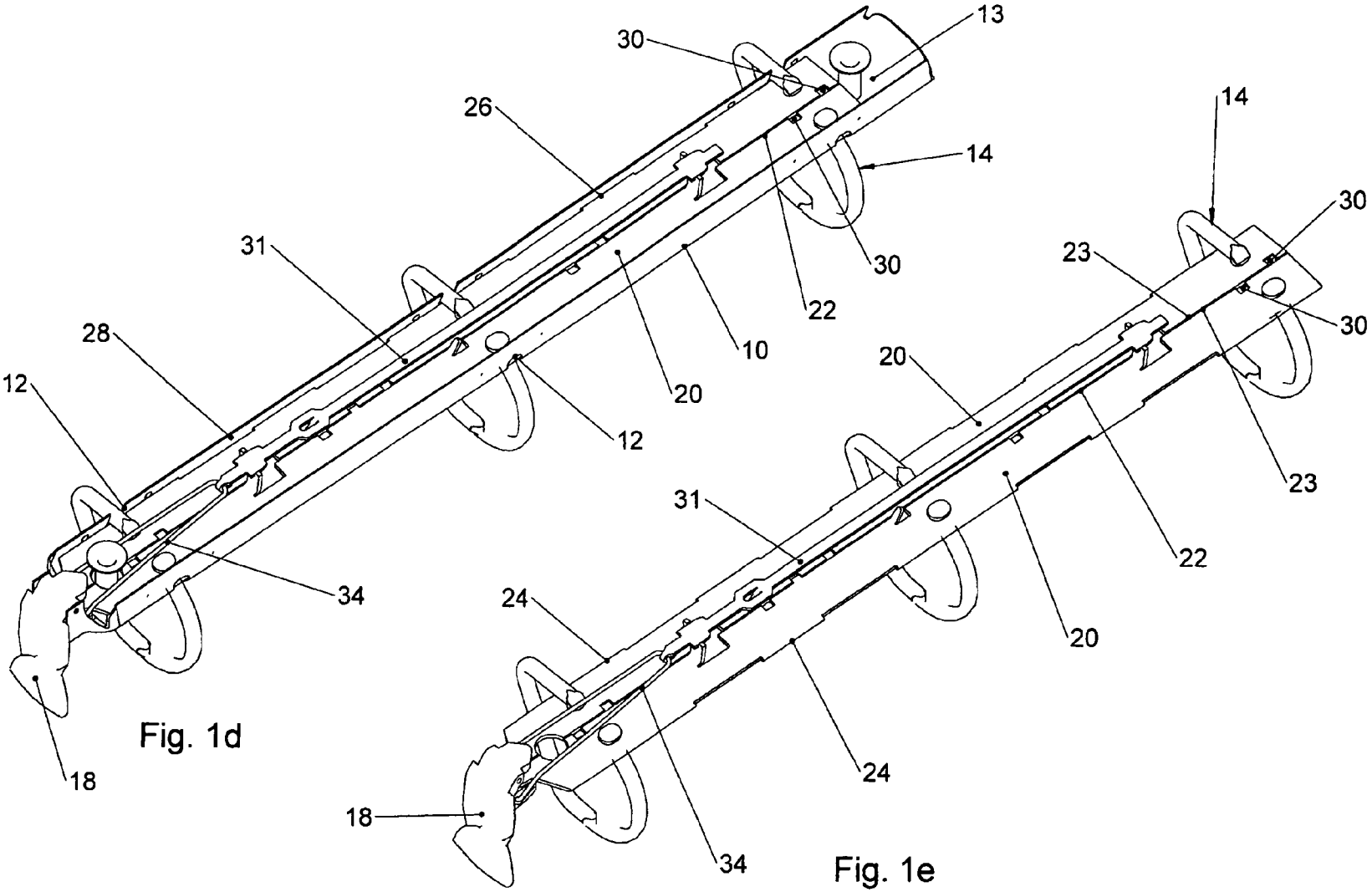
Figures 2A, 3A:
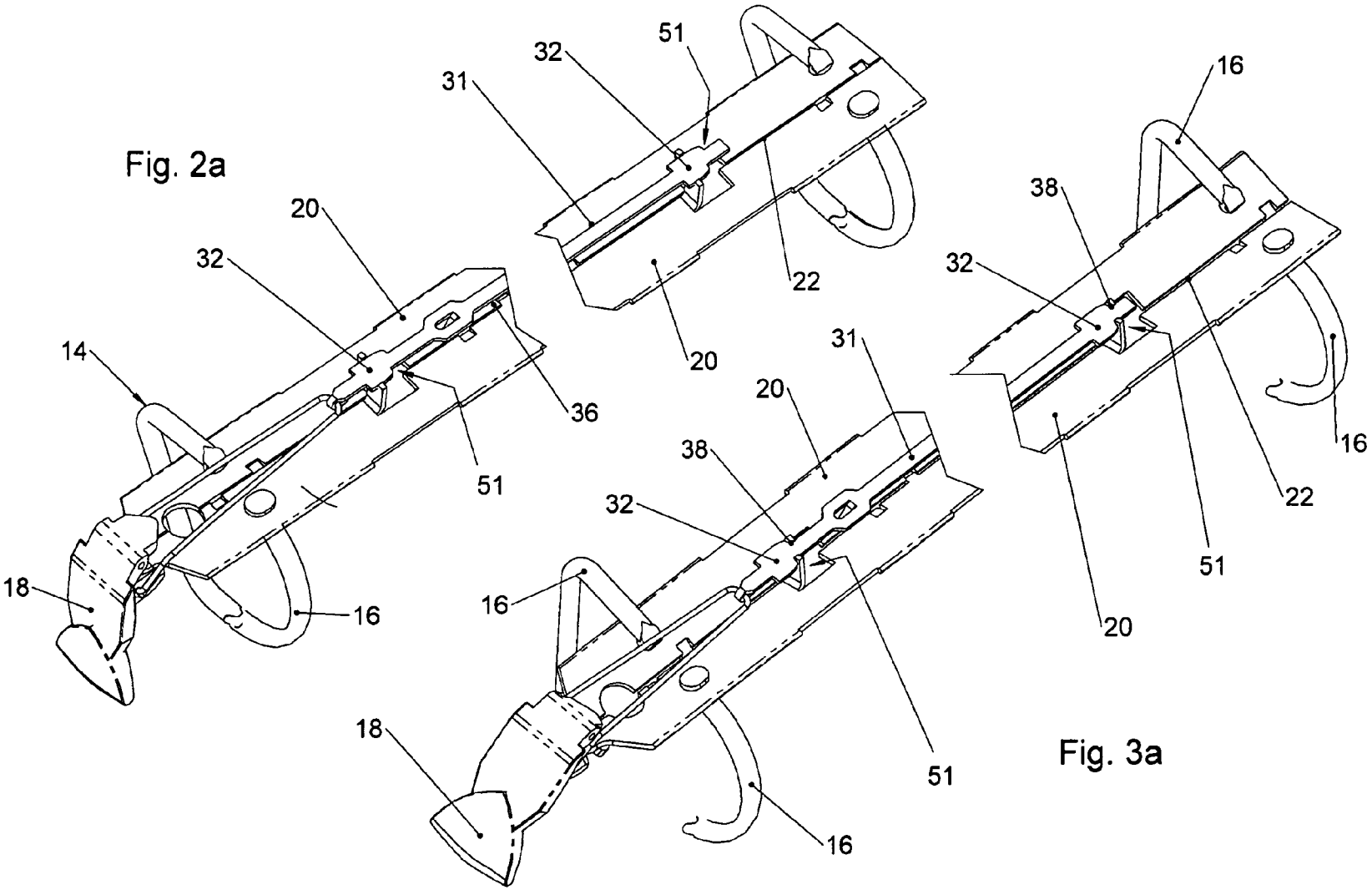
FIGS. 2*a*-2*c*. A perspective bottom view, a longitudinal side view and an end view (partial section) of the mechanism of FIGS. 1*a*-1*d* with the housing removed and in the closed position.
FIGS. 3*a*-3*c*. A perspective bottom view, a longitudinal side view and an end view (partial section) of the mechanism of FIGS. 2*a*-2*c* with the housing removed and in the open position.
Figure 2C:
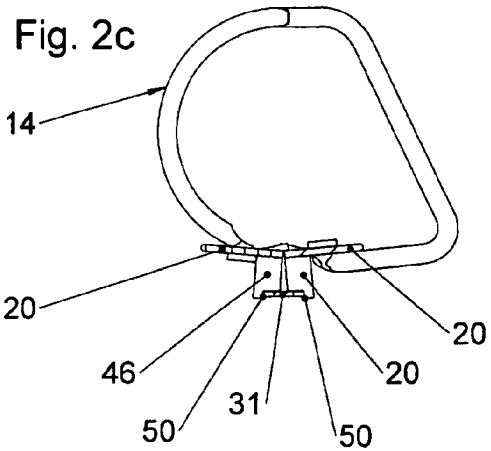
Figure 2B:
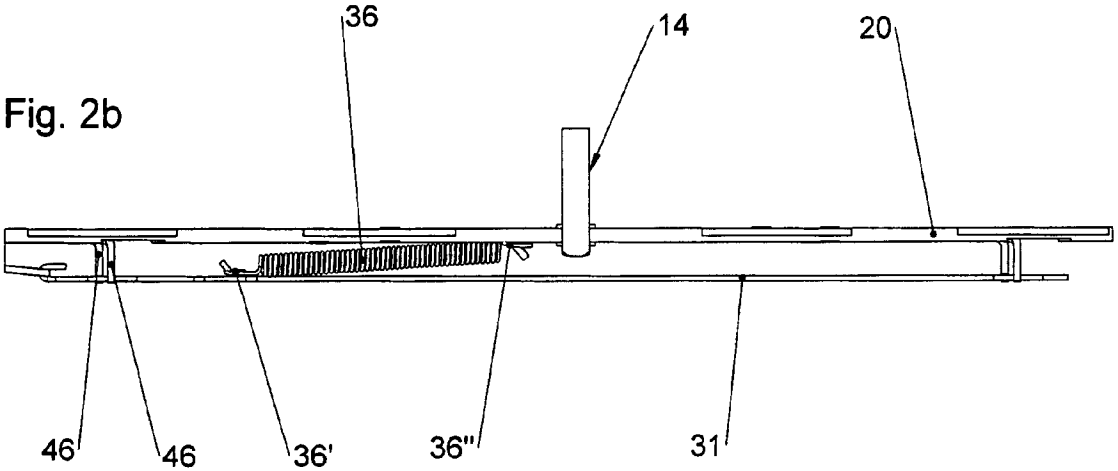
Figure 3C:
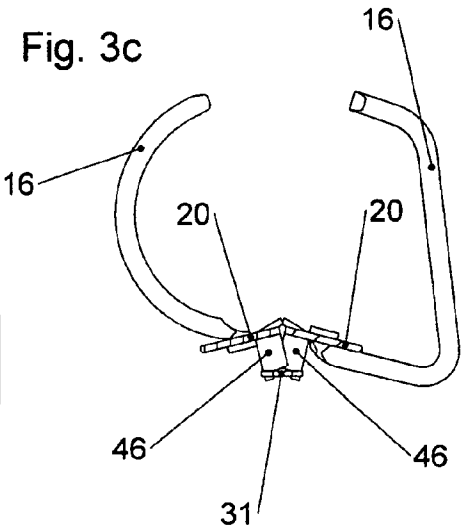
Figure 3B:
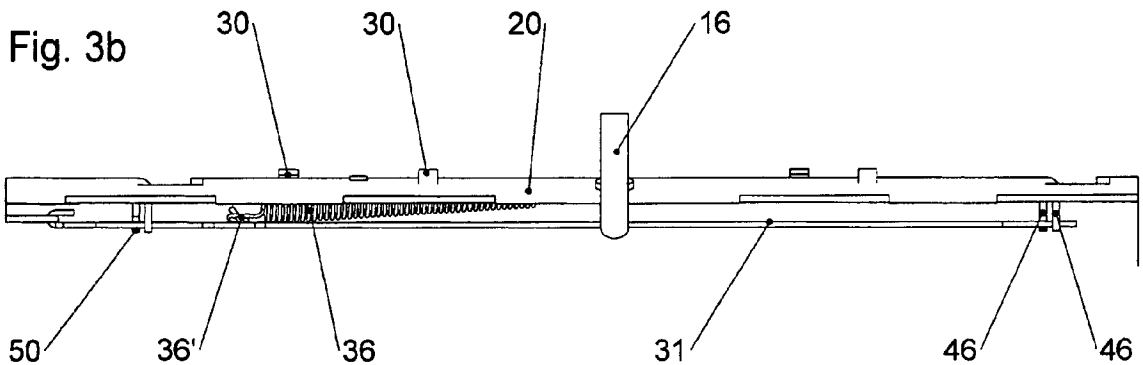
Figure 4B:
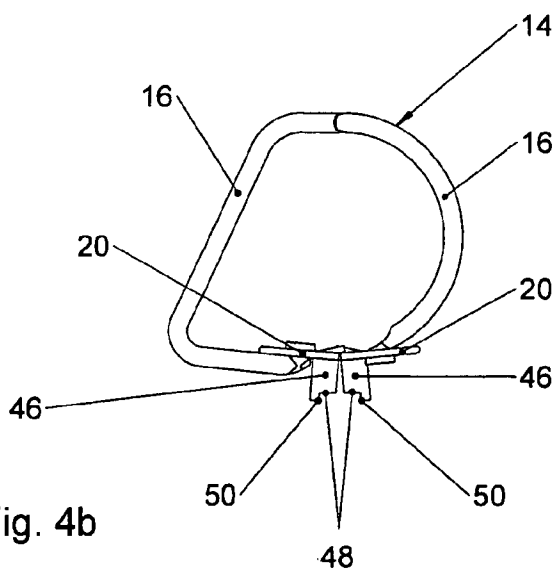
FIGS. 4*a* and 4*b*. A bottom perspective view and an end view of the carrier rails of the mechanism of FIGS. 2*a*-2*c* without the locking rod in the closed position.
Figure 4A:
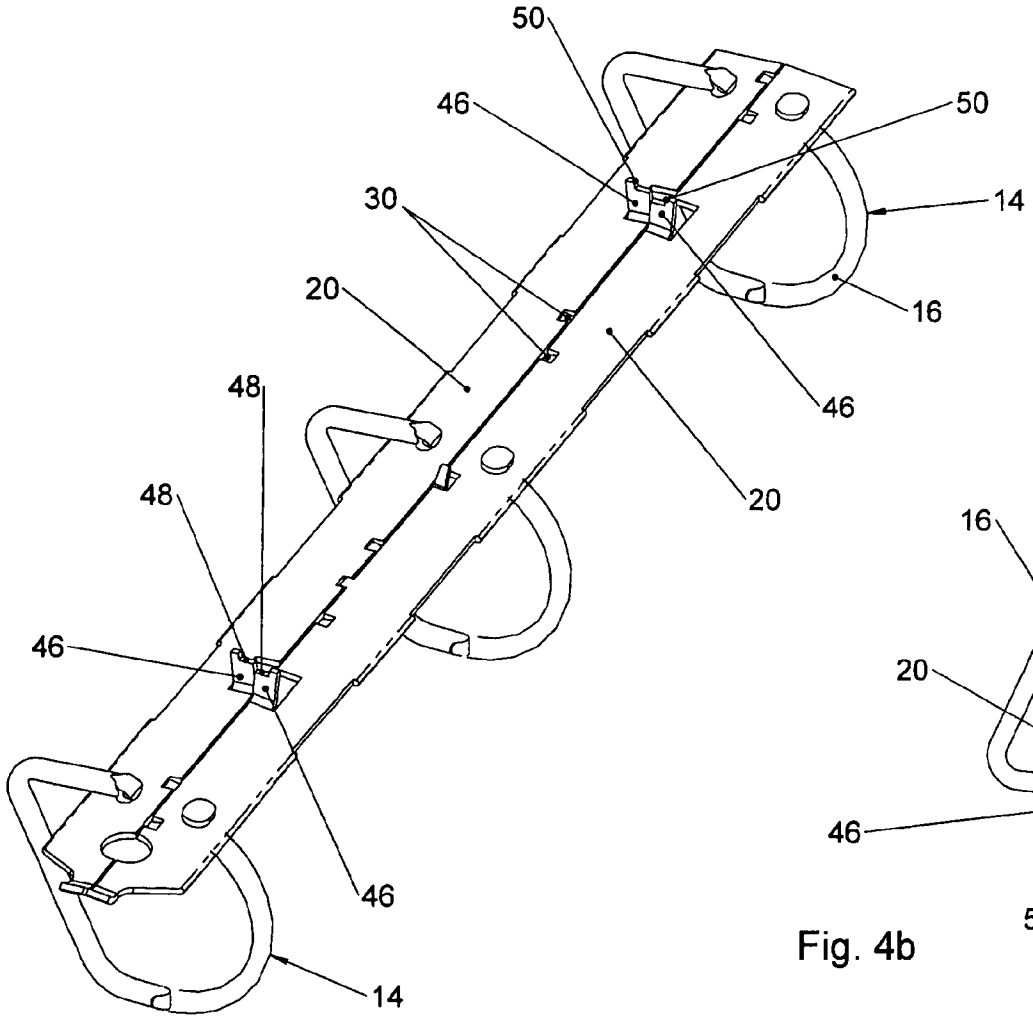

In addition, in all illustrative embodiments a locking rod 31 is provided displaceable via the actuating element 18 essentially parallel to the linkage axis 22 relative to the housing 10 and the carrier rails 20, to which the locking elements 32, 32', 32", 32'", are rigidly connected. The locking elements of the locking rod 31 are intended to block the pivot path of the carrier rails 20 in the closed position and in their open position to free the linkage axis 22 in concert with a bearing element or surface positioned along the exterior or bottom side of the carrier rails or the housing flanks. The locking rod 31 is located in all illustrative embodiments on the side of the carrier rails 20 opposite to the housing wall 13, i.e. the exterior or bottom side of the carrier rails. It is in almost all illustrative embodiments (with the exception of FIGS. 24 through 26) pretensioned in the direction of the closed position with its locking element under the influence of a closing spring 36. The closing spring 36 is in each case in the form of a pull spring, which with its one end 36" is fixed in one of the carrier rails and with its other end 36" is fixed to the locking rod 31 and which exercises upon the locking rod 31, besides the pretensioning in the longitudinal direction of the carrier rails 20, a force component in the direction of the carrier rails 20 (See FIG. 1*c*). The locking rod is displaceable in the opening direction, via the actuating lever 18 and a connecting element 34 made of a bent wire, against the force of the closing spring 36 and thus unlockable with its locking elements 32, 32', 32", 32'". In the open position the locking elements 32, 32', 32", 32'" lie against a detent or stop. (FIGS. 3*a*, 6*a*, 11*c*, 12*b*). From the open position the locking rod 31 can be released out of the opening position in the locking direction either via the actuating element 18 or by pressing together of the half-rings 16 against the force of the locking spring 36, so that upon the continuation of the closing path or sequence it automatically reaches its closed position under the influence of its pretensioned closing spring 36 and there locks the carrier rails 20. The actuating element 18 further includes an opening strut or projection 40 (FIGS. 5*b* and 7*a*) abutting in the opening direction against the carrier rails 20 and pivoting these from the closed into the open position with overcoming of the spring force produced by the housing flanks 28. Further, the actuating element 18 is provided with a closing strut 42 (FIGS. 5*b* and 7*a*) abutting in the closed direction against the carrier rails 20 and pivoting through from the open into the closed position upon overcoming of the spring force applied by the housing flanks 28. Besides this it is possible that the locking rod is displaceable in the closing direction also directly via the carrier rails 20 by actuating of the half-rings 16 against the spring force of the closing spring 36. Accordingly the actuating element 18 exhibits both in the open and in the closed position two, effective in different angular positions, actuating positions for the subsequent actuation of the carrier rails 20 and the locking rods 31.

The same applies for the illustrative embodiments according to FIGS. 24*a* through 26*c*. However, in these embodiments the closing spring 36 is missing, so that the opening and closing of the half-rings 16 can occur exclusively via the actuating element 18. The closing by pressing together of the half-rings 16 is in that case not possible. The connecting element 34 ensures displacement of the locking rod 31 and the locking element 32 both in the closing direction as well as in the open position and acts therewith, depending upon actuating direction, as a pressure element or pull element. The locking corresponds otherwise to the illustrative embodiments according to FIGS. 16*a* through 20*b* by means of a flap or plate-like support strut 90, of which the design and function will be described in greater detail below.

Figure 15A:
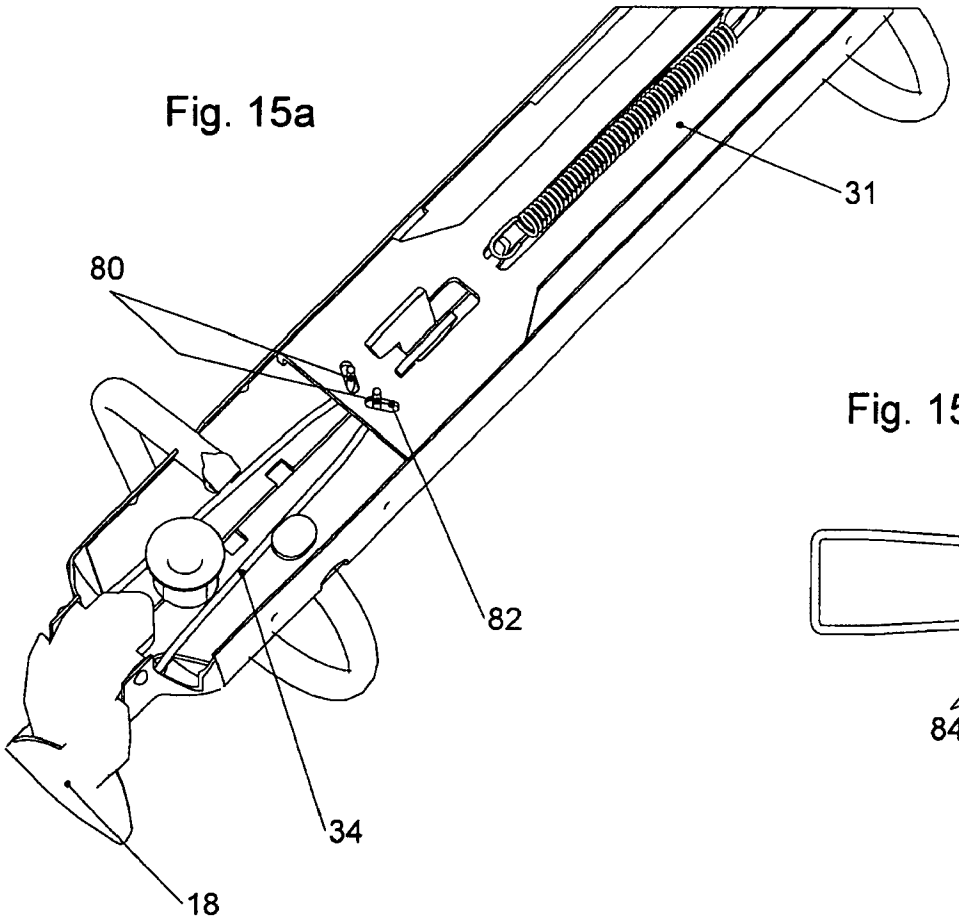
FIG. 15*a*. A partial bottom perspective view of the ring binder mechanism of FIG. 12*b* modified to include angled guide slots in the locking bar.
Figure 15B:
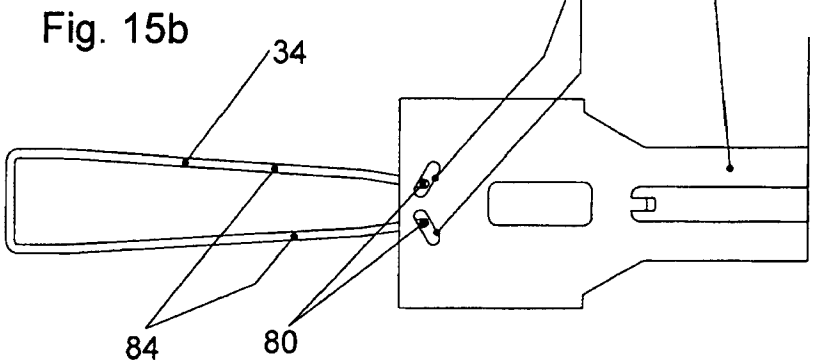
FIG. 15*b*. A partial top view of the locking rod with connecting element of the ring binder mechanism of FIG. 15*a;*
Figure 15C:
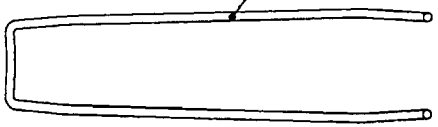
FIG. 15*c*. The connecting element of the ring binder mechanism according to FIGS. 15*a* and 15*b* in untensioned condition.

In the illustrative embodiment according to FIGS. 15*a* through 15*c* the connecting element 34 provided between the actuating lever 18 and locking rod 31 is in the form of a U-shaped bent piece of wire, of which the ends of the shanks 80 are bent hook-like and inserted into openings 82 in the locking rod 31. The openings 82 therein form guide slots or connecting links oriented diagonal to the direction of displacement of the locking rod 31 such that the shank ends 80 are guided toward each other to the lower end of the slot when the locking rod is pulled into the locked position. The shanks 80 of the pull element 34 are pretensioned in this hooked-in condition spring elastic against each other, so that the actuating element 18 renders at least the closed position free of looseness or play. In the illustrative embodiment shown in FIGS. 15*a* through 15*c*, the guide slots 82 form elongated longitudinal holes that combined form a V-shape. The base of the V is facing the actuating element 18, while the shanks 84 of the pull element 34 exhibit a pretension urging the shanks outwards. The pretensioning of the shanks 84 causes the hook shaped ends 80 inserted within the V-shaped guide slots of the connecting element 34 and the actuating element 18 to pull with a slight spring force in the closing direction of the locking rod 31. By this means it is ensured that the actuating element always lies in the housing in the closed position without play.

In FIGS. 21*a* through 23*c* there are shown modified embodiments for the connecting element 34. The connecting elements 34 are there shown as bent pieces of wire, which with their bent ends 80 engage in recesses 83 of the locking rod, which are not in the form of guide slots. The elastic pretensioning is here exclusively brought about by the bends 106 at one of the shanks 108 of the piece of wire, which in the locking position of the actuating element 18 lead to an elastic stretching by the amount a (FIGS. 23*a* and 23*c*) and therewith to an elastic pretensioning, which renders the actuating element 18 free of play in the locking position.

It is common to all illustrative examples, that the locking elements 32, 32', 32", 32'", for receiving the locking forces in the closing direction, are supported not at the carrier rail 20 oppositely lying housing wall 13, but rather at selected parts of the exterior or bottom surface of carrier rails 20 or the housing flanks 28 as bearings or abutments.

In the illustrative embodiments shown in FIGS. 1 through 7*d* the carrier rails 20 respectively exhibit two lever arms 46 extending rigidly from the area of the linkage axis 22 outward from the locking rod 31, which lever arms 46 are in the form of a strip, stamped and bent out of the sheet metal of the carrier rail 20, and which at the engagement level of the locking rod 31 exhibit a jog or notch forming a guide step 48 and a thereto perpendicular bearing edge 50. The locking rod 31 respectively includes two control curves 51 pair-wise oriented towards opposite sides, facing the lever arm 46, lying on the guide step 48 and against the bearing edge 50, which form an opening section 52 running along the longitudinal central plane closer to the linkage axis 22 and further from the longitudinal plane of sliding section 54, such that the locking rod is narrower in the area of the opening section 52. The closing segments 54 pair wise collectively forms a locking element 32, which, in the locking position of the carrier rails 20 and the half-rings 16, lie against the bearing edge 50 of the lever arm 46 and thereby hold the carrier rails 20 form-fittingly in their closed position.

Upon opening of the rings 14 via the actuating lever 18 the locking rod 31 is so displaced against the closing spring 36 parallel to the longitudinal axis 22, that the opening section 52 extends into the area between the bearing edges 50. Thereby the pivot path of the carrier rails 20 about their pivot axis 22 is freed, so that they can reach their open position. In the open position, the locking rod 31 lying upon the guide step 48 abuts or impinges with the transition edges 56 between the opening section 52 and the closing section 54 under the influence of the closing spring 36 against an opening detent 38 formed in the face edge of the adjacent lever arm 46. Thereby also the open position of the half-rings 16 within the ring binder mechanism is ensured to be form fitting.

Figure 6A:
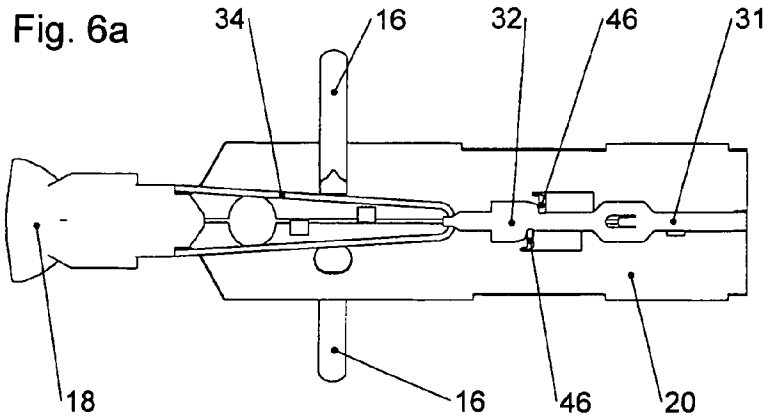
FIGS. 6*a* and 6*b*. A partial bottom view and partial longitudinal side view of the mechanism of FIGS. 5*a* and 5*b* in the open position.
Figure 6B:
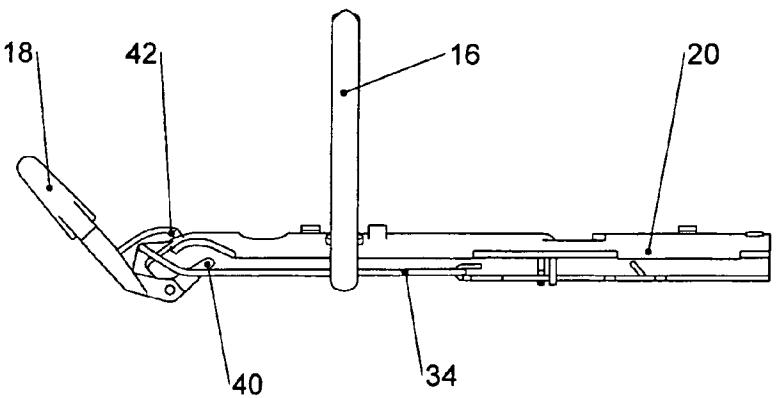
Figure 5A:
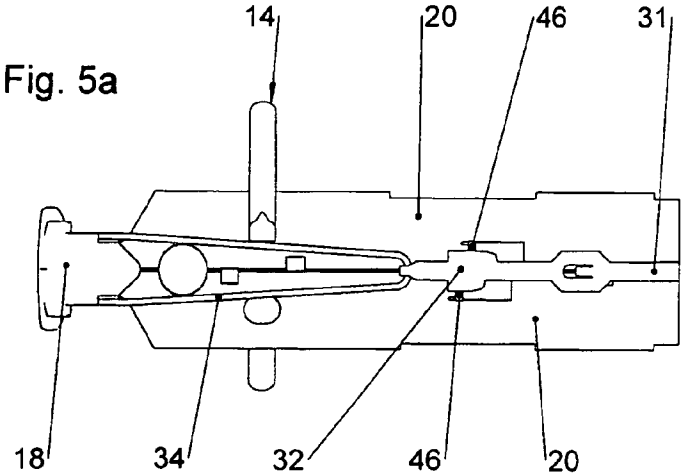
FIGS. 5*a* and 5*b*. A partial bottom view and partial longitudinal side view of the mechanism of FIGS. 2*a*-2*c* in the closed position.
Figure 5B:
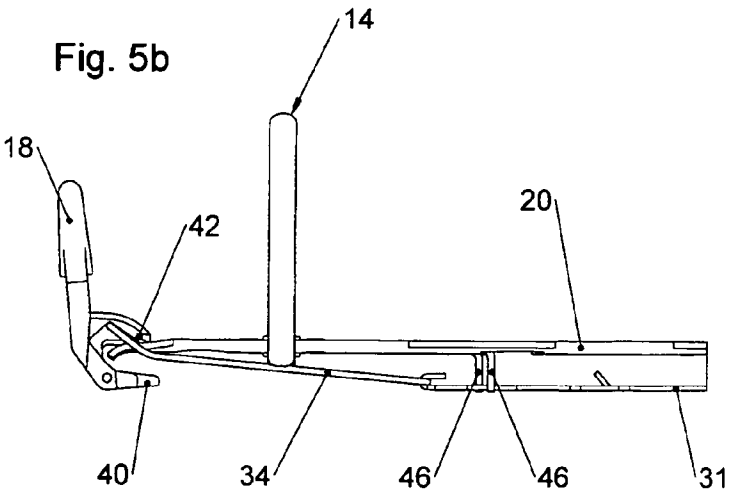
Figures 7A, 7B, 7C, 7D:
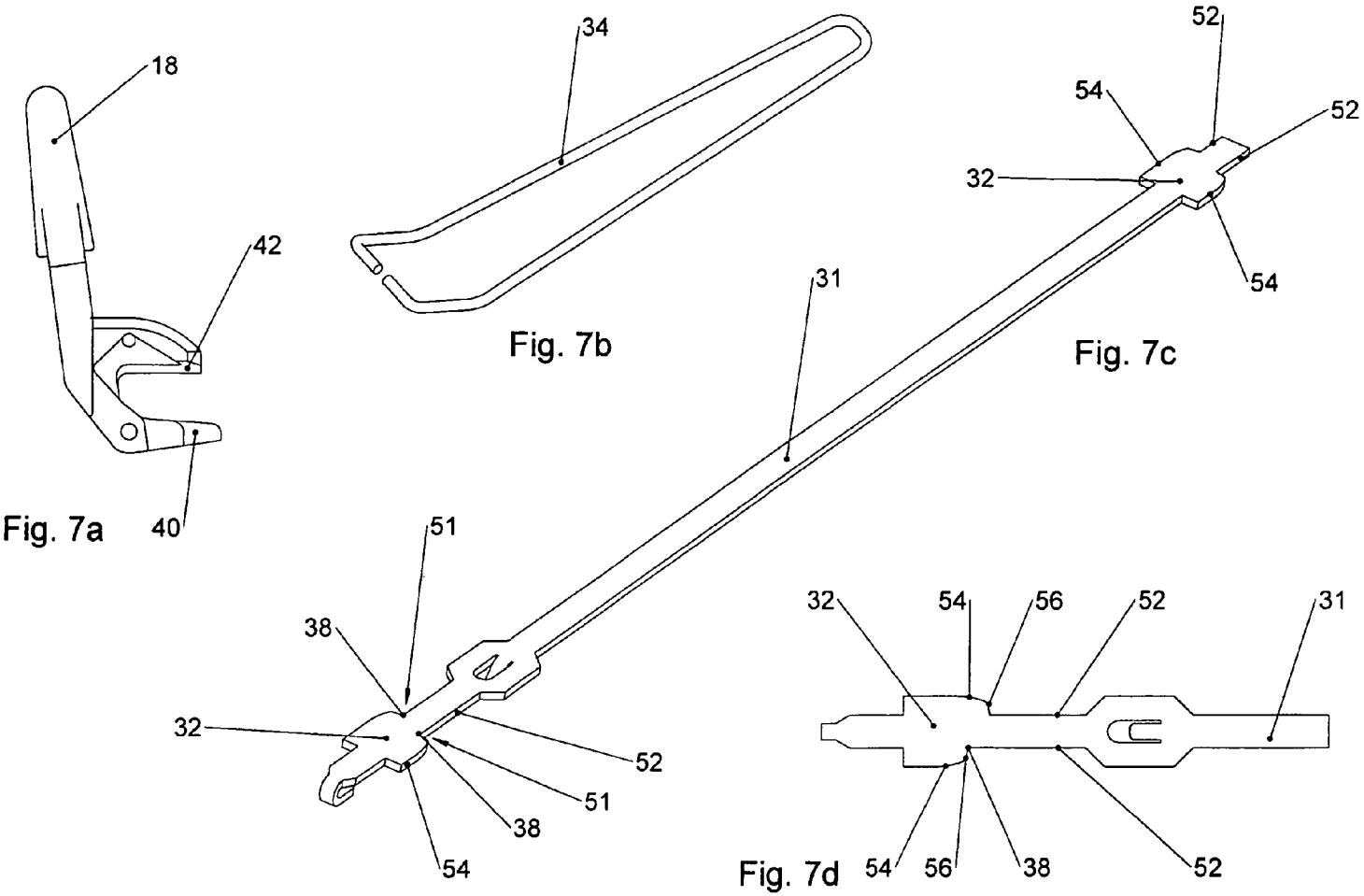
FIGS. 7*a*-7*d*. A side view of the activating element, a perspective view of the connecting element, a perspective view of the locking rod and a partial top view of the locking rod of the first embodiment of the ring binder mechanism of FIGS. 1*a*-1*d* in various views.
Figure 8A:
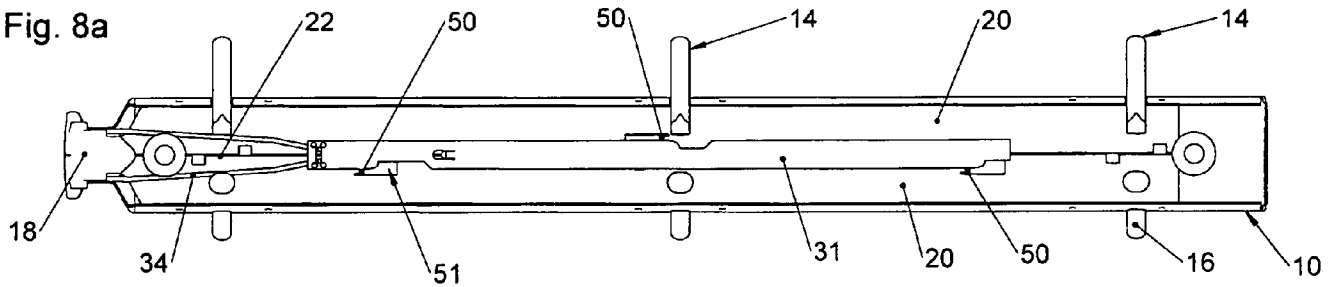
FIG. 8*a*. A bottom view of a second embodiment of the ring binder mechanism with the rings in a closed position.
Figure 8C:
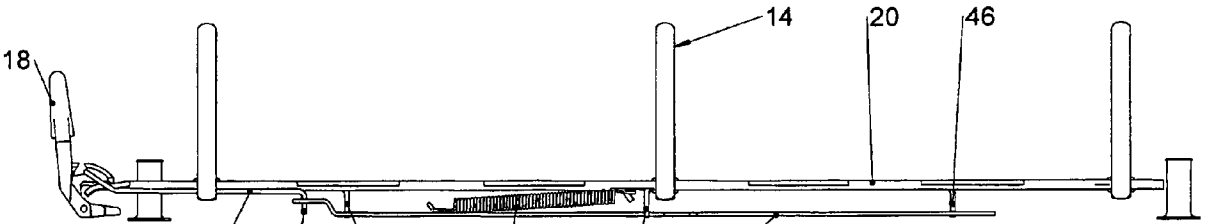
FIG. 8*c*. A longitudinal side view of the ring binder mechanism of FIG. 8*a* with the housing removed.
Figure 8B:
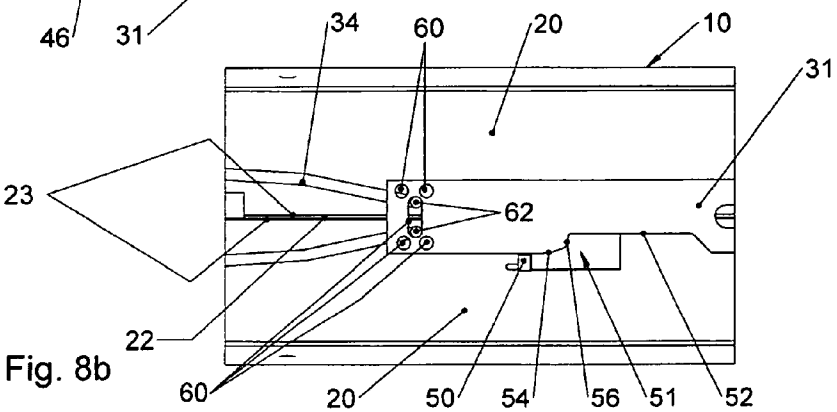
FIG. 8*b*. A partial and enlarged bottom view of the ring binder mechanism of FIG. 8*a;*
Figures 8D, 8E:
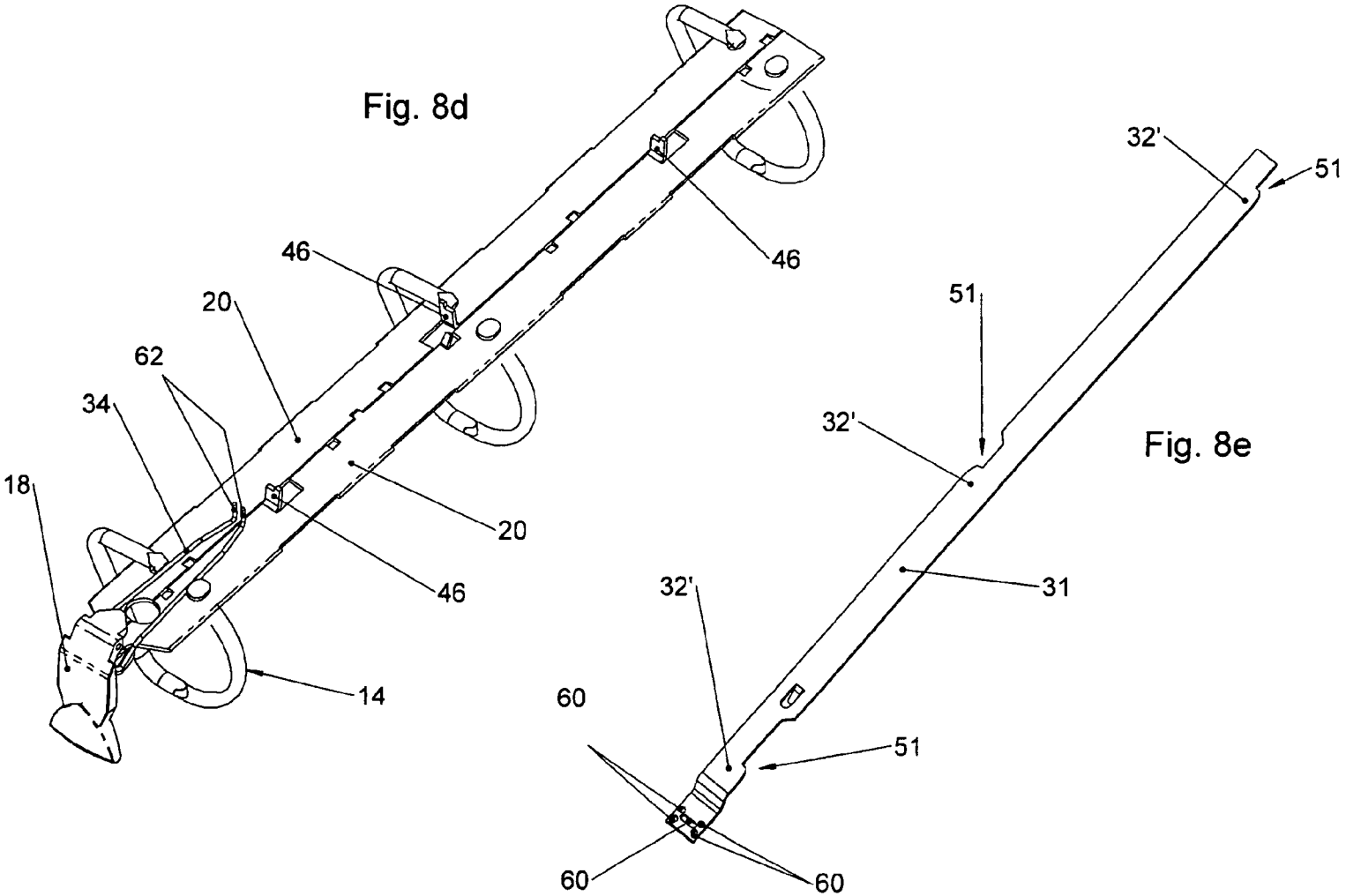
FIG. 8*d*. A bottom perspective view of the mechanism of FIG. 8*c* without the locking bar.
FIG. 8*e*. A bottom perspective view of the locking rod of FIG. 8*a;*
Figure 9A:
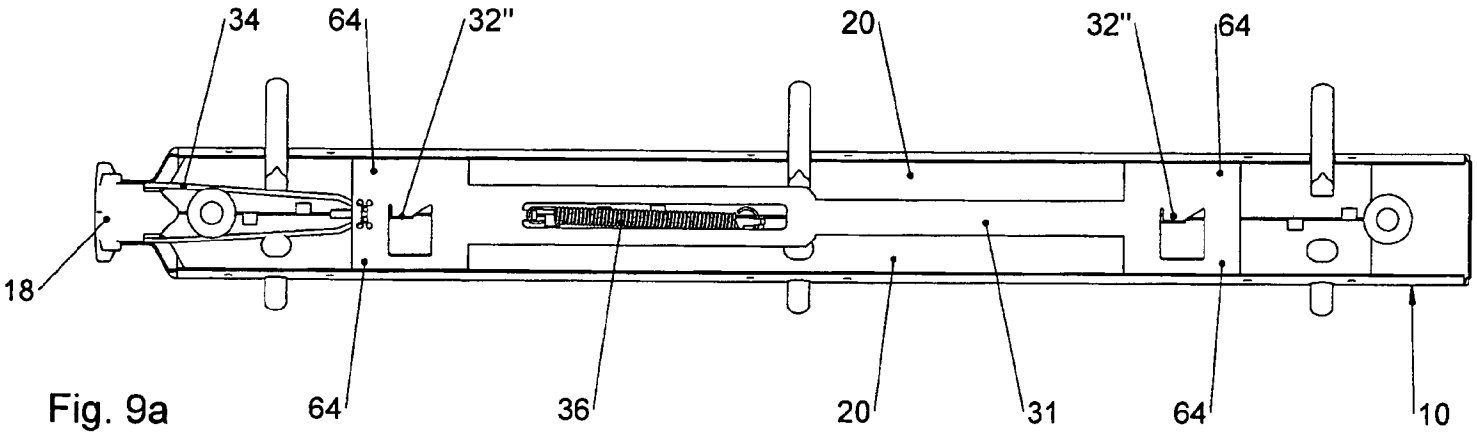
FIG. 9*a*. A bottom view of a third embodiment of the ring binder mechanism.
Figure 9B:
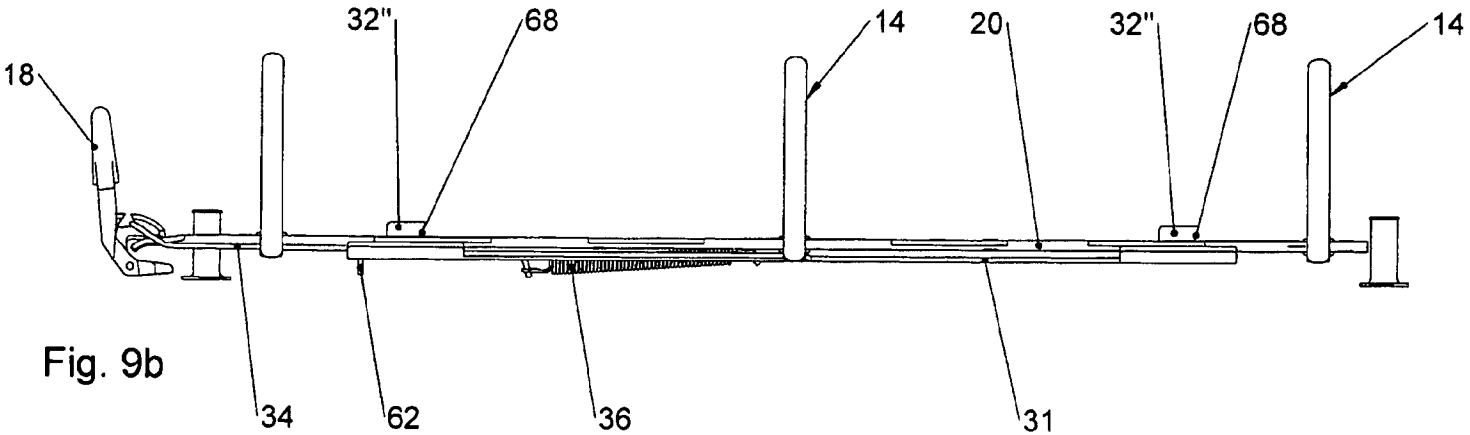
FIG. 9*b*. A longitudinal side view of the ring binder mechanism of FIG. 9*a* with the housing removed.
Figures 10A, 11A:
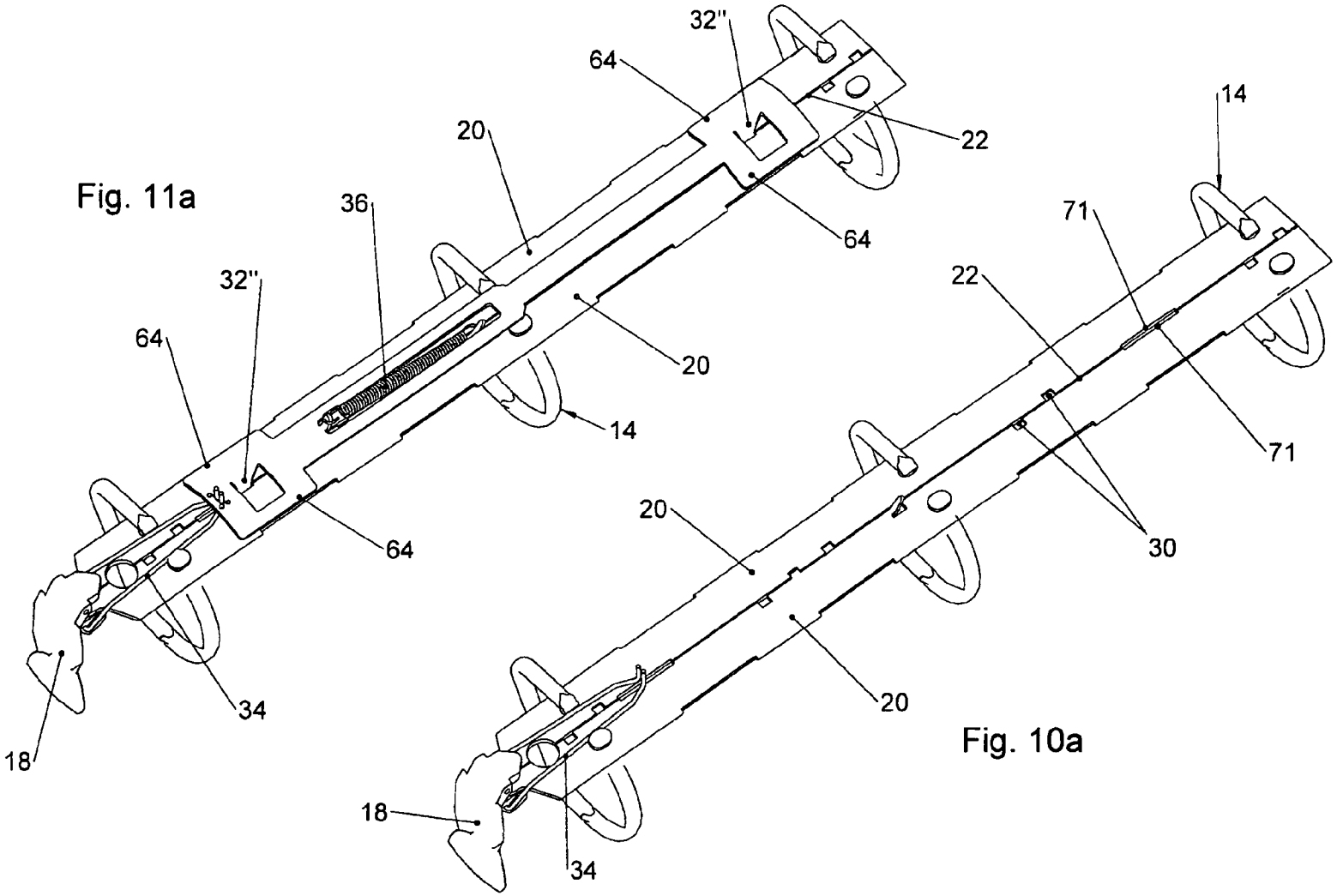
FIGS. 10*a* through *c*. A bottom perspective view of the carrier rails with actuating lever of the ring binder mechanism of FIG. 9*a* in the locked position, the locking rod, and a longitudinal side sectional view of the locking rod.
FIGS. 11*a* and 11*b*. A bottom perspective view of the ring binder mechanism of FIG. 9*a* and an end sectional view in the closed position.
Figures 10B, 10C, 11B, 11C, 11D:
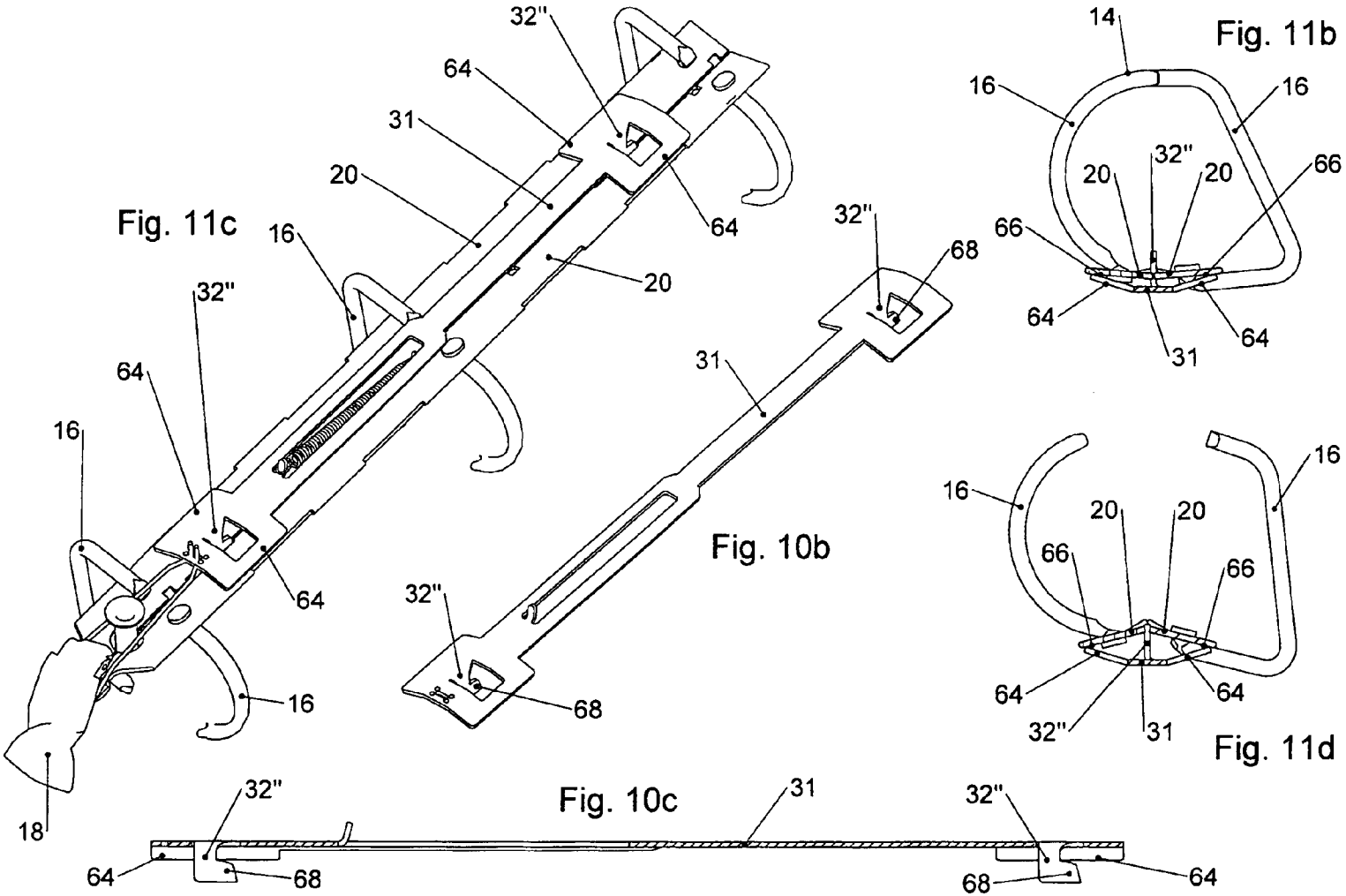
FIGS. 11*c* and 11*d*. A bottom perspective view of the ring binder mechanism of FIG. 9*a* and an end sectional view in the open position.

As can be seen in particular in FIGS. 5*a* and 6*a*, in the illustrated embodiment the lever arms 46 pair-wise exhibit a small spacing or offset in the direction of displacement, which ensures that they do not collide with each other in the open position and during the actuating process. It can further be seen above all from FIG. 1*d* that in the illustrated three-ring mechanism only two locking elements 32 are provided, which are provided spaced apart from the rings. With such an arrangement it is accomplished that the housing and carrier rails between the rings 14 and the locking and bearing elements 32, 46 can contribute with their elastic deformation to the building up of a pretension during the closing process.

The illustrative variant shown in FIGS. 8*a* through 8*e* of a ring binder mechanism differs from the above-described mechanism thereby, that the locking rod 31 includes only three and not four control curves, of which two are provided on one longitudinal edge of the locking rod, and only one is provided on the other. Accordingly, out of the carrier rails 20 on the one side two-lever arms 46 are bent out and on the other side one lever arm 46 is bent out. Here also the control curves form a narrower opening segment 52 along the longitudinal edge of the locking rod 31 in the direction of the longitudinal center plane and a wider outwardly lying closing section 54, which transition into each other along a transition edge 56. The closing sections 54 define locking elements 32', which in the closed position lie form-fittingly against the abutment or bearing edges 50 of the adjacent lever arms 46 and hold the carrier rails 20 in their closed position (See FIGS. 8*a* through 8*c*). During actuating of the locking rod 31 via the actuating element 18 the locking element 31 with its opening section 52 extends into the area of the lever arm 46, so that the carrier rails 20 can pivot about their linkage axis 22 through into the open position. In the open position the locking rod 31 abuts or lies with the transition edge 56 against the opening detent 38 of the adjacent lever arm 46.

The closing spring 36 ensures that the locking rod 31 is continuously pulled with a force component against the guide step 48 of the lever arm 46. In order to compensate for manufacturing tolerances, a number of openings 60 are provided at the actuating element end of the locking rod 31, into which the bent-away ends 62 of the connecting element 34 can be inserted.

In the illustrative example according to FIGS. 9*a* through 11*d*, on the locking rod 31, in the proximity of their ends, two hook-like locking elements 32" are stamped out of the rod plane and bent inward in the direction of the carrier rails 20 such that they can extend, through edge open cut-outs in the area of the longitudinal edges 23 to the interior side of the carrier rails 20. The locking rod 31 stamped out of a sheet metal also includes support bearing strips 64 projecting sideways beyond the locking elements 32", which form a wide angle or arc with each other (FIGS. 11*c* and 13*b*) or are bent away at their projecting side edges 65 toward the carrier rails (FIG. 13*c*), and with which the locking rod 31 supports itself upon the carrier rails. The carrier rails 20 form a support or bearing surface 66 on the concerned locations for the support strips 64 (see in particular FIG. 11*b*).

In the closing process the hook part 68 of the locking element 32" is displaced with the assistance of the closing spring 36 under the longitudinal edges 23 of the carrier rails, so that the carrier rails 20 in their closed position can be held form fittingly secured. The support plates 64 lie against the bearing surfaces 66 insuring that a supplemental elastic pre-tensioning can be built up in the closed position. During the opening process, which is initiated via the actuating element, the locking elements 32" extend or come with their hook parts 68 in the area of the edge-open recesses 71 between the carrier rails 20, so that the carrier rails 20 can pivot through into their open position (FIGS. 11*a* through 11*d*). The illustrative embodiment shown in FIGS. 12*a* through 14*d* differs from the illustrative embodiment according to FIGS. 9*a* through 11*b* in that the locking rod 31 includes on it ends a locking opening 72 bordered by a locking bar 70, and the carrier rails 20, include two engagement elements 74 in the area of their each other facing longitudinal edges, provided spaced apart from each other and pair wise adjacent A hook part 76 on the locking elements engages or extends through the respective adjacent locking opening 72 of the locking rod 31 and in the closed position engages or reaches with the hook part 76 over the locking bar 70 which serves as the locking element 32'''.

Figure 13A:
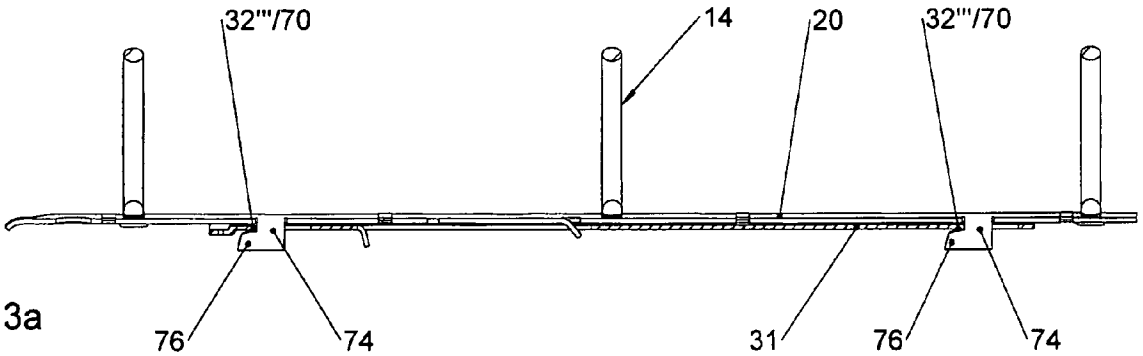
FIGS. 13*a* and 13*b*. A side view taken along the inner edge of one of the carrier rails with a longitudinally sectioned locking rod, and a perspective bottom view of the locking rod of the ring binder mechanism of FIGS. 12*a* and *b;*
Figure 13C:
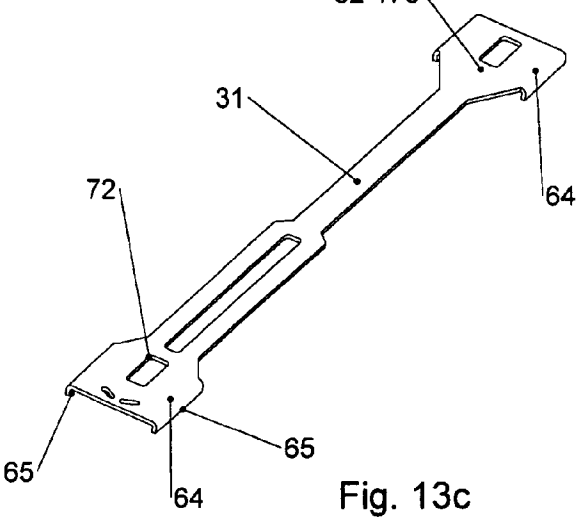
FIG. 13*c*. A perspective bottom view of a locking rod differing relative to FIG. 13*b* with the support strip or plate bent on the projecting or protruding side edges.
Figure 13B:
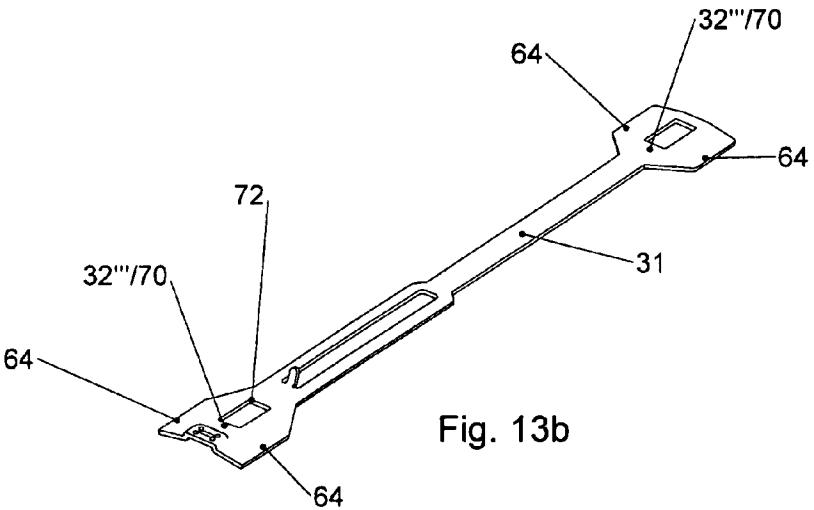
Figures 14A, 14B:
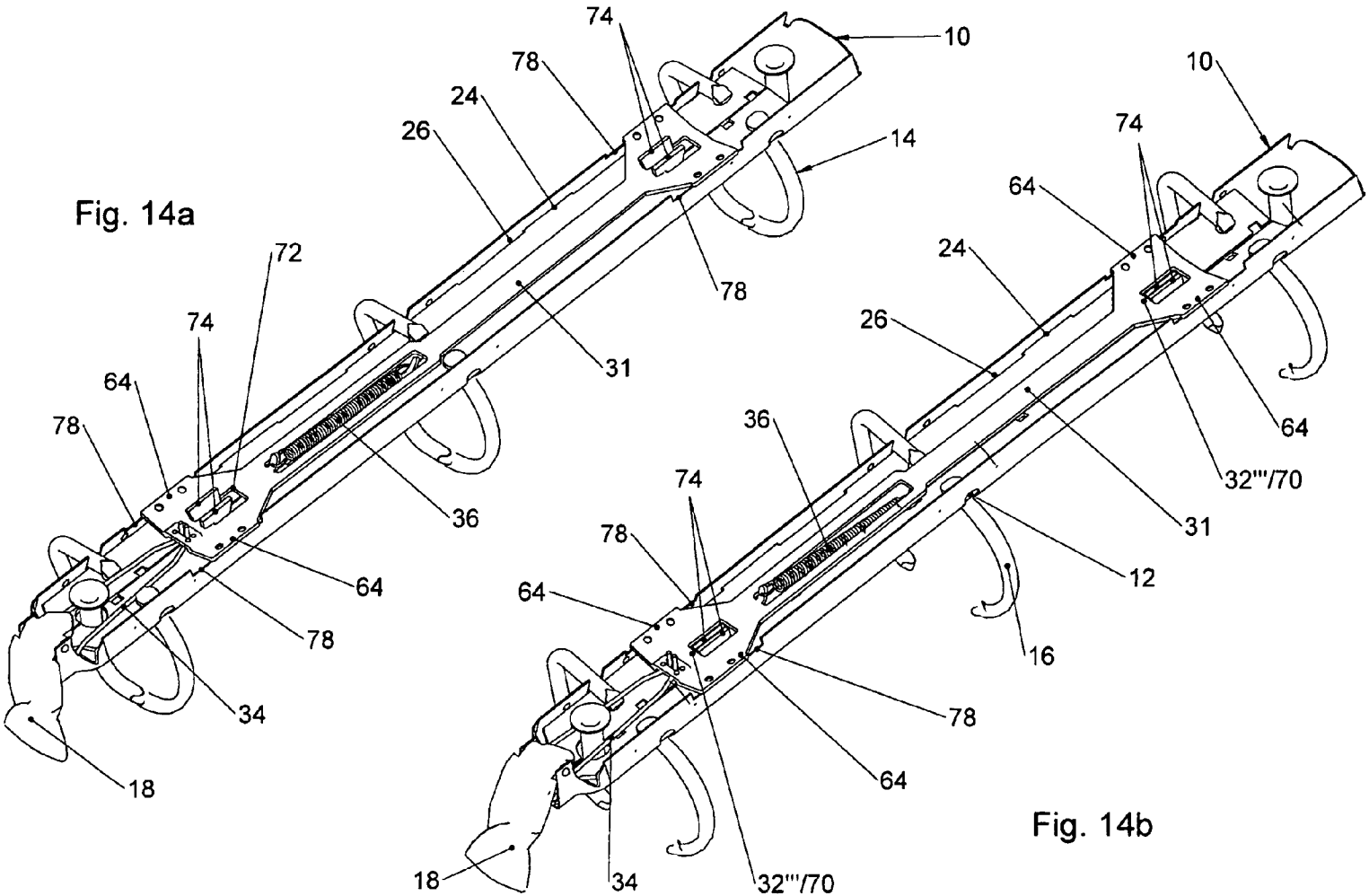
FIGS. 14*a* and 14*b*. A perspective bottom view of a fifth embodiment of the ring binder mechanism in the closed position and in the open position.
Figure 14C:
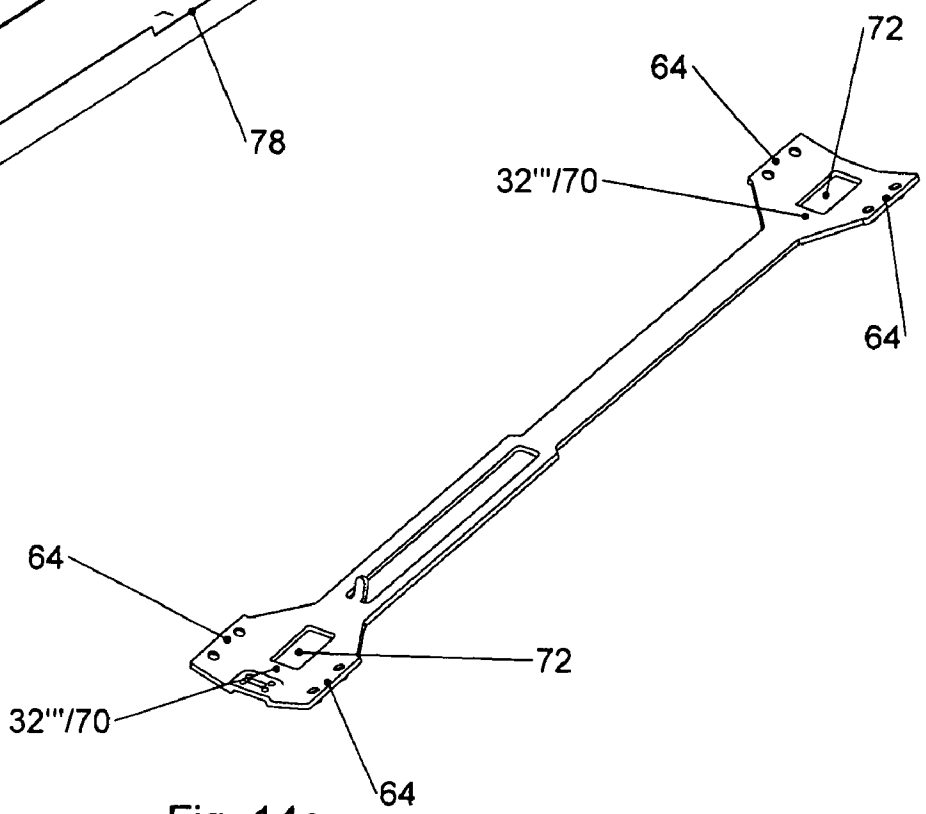
FIGS. 14*c* and 14*d*. A perspective bottom view of the locking rod and the housing of the ring binder mechanism according to FIGS. 14*a* and 14*b;*
Figure 14D:
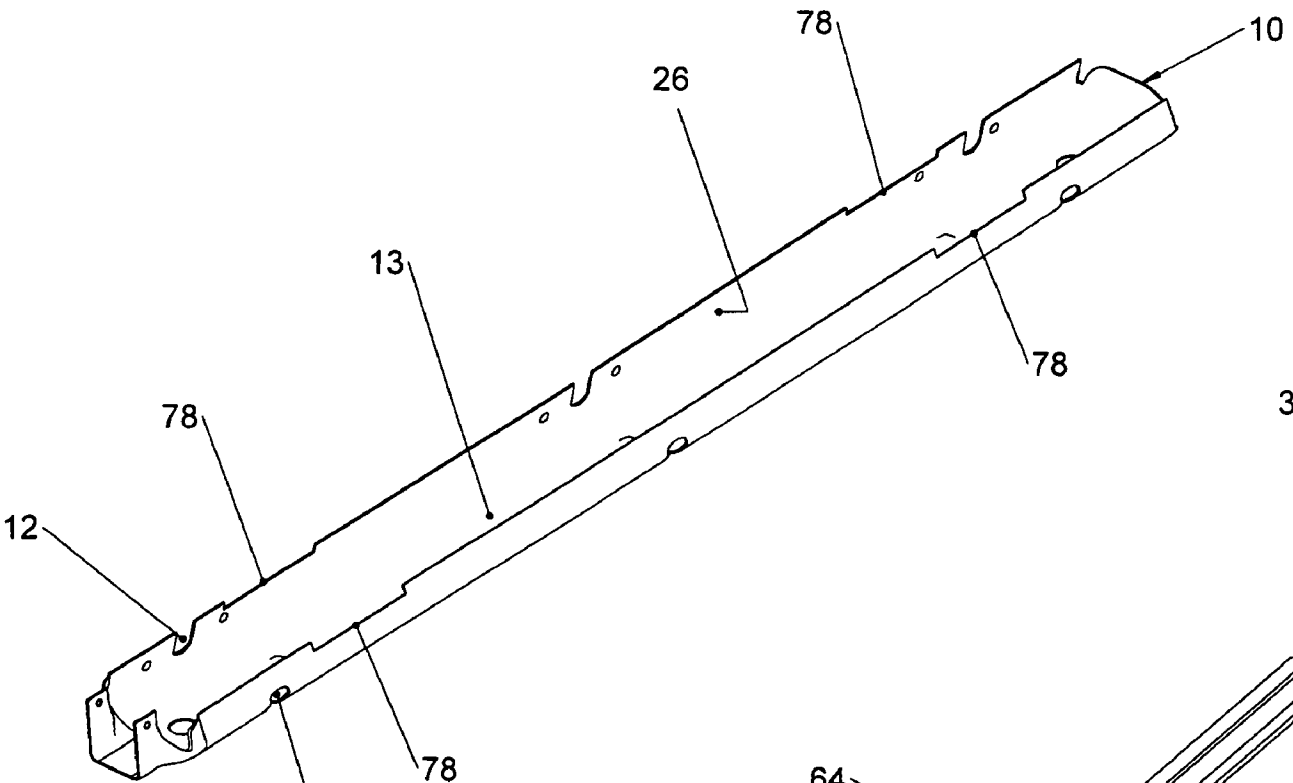

In the illustrative example according to FIGS. 12 through 13*b* the support strips 64 projecting sideways in the area of the locking rod 70 support themselves as in the previously described illustrative embodiments upon bearing surfaces 66 of the carrier rails 20 while in the case of the illustrative example according to FIG. 14*a* through *d* they support against the free bearing edges 78 of the housing flanks 28.

In the closing process the engagement elements 74 extend through the locking openings 72 and are displaced, with the assistance of the closing spring 36, over the locking element 32''' in the form of the locking bar 70. Thereby one obtains a form-fitting connection that produces an elastic pretension via the support strips 64 and the associated bearing surfaces 66 or bearing edges 78. During the opening process, which is initiated by the actuating lever 18, there is a displacement of the locking rod 31 until the hook part 76 of the engagement element 74 can be pivoted out of engagement with the locking rod 70 and the carrier rails can pivot into their open position.

Figure 20A:
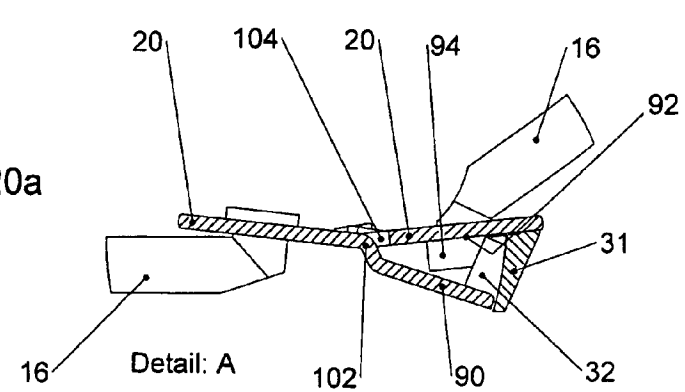
FIGS. 20*a* and 20*b*. Enlarged partial end view of the details A and B of FIGS. 19*a* and 19*b;*
Figure 20B:
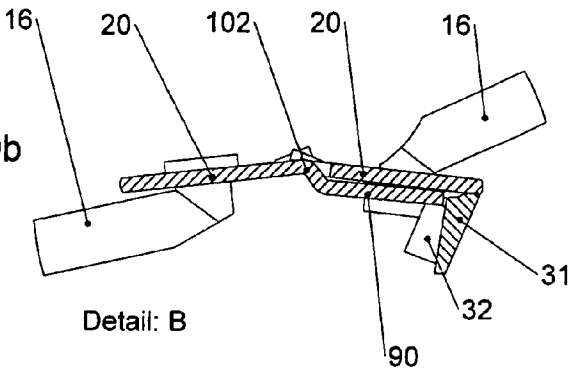
Figure 19A:
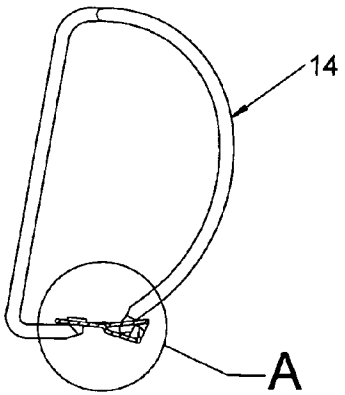
FIGS. 19*a* and 19*b*. End sectional view taken through the binder mechanism according to FIGS. 16*a*-16*d* in the area of a support strut on one of the carrier rails in the closed position and in the open position.
Figure 19B:
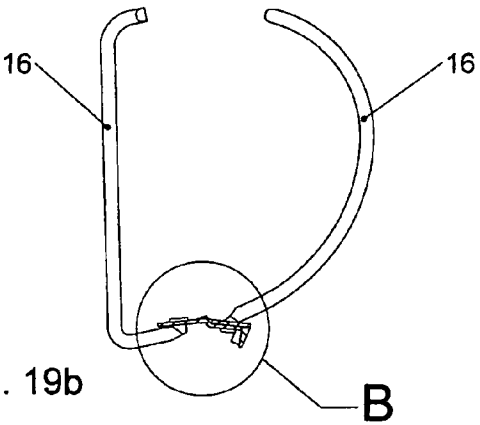
Figure 21C:
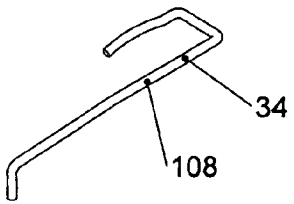
FIGS. 21*a*-21*d*. Perspective view of the top of the locking rod with connecting element and actuating element according to FIGS. 17*a* and 17*b* in assembled condition, a partial view of the bottom of the locking rod, a perspective view of the connecting element in disassembled condition, and an enlarged detail view of detail C of FIG. 21*b;*
Figure 21D:
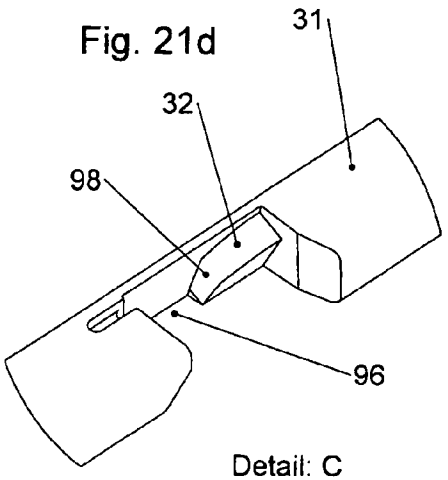
Figure 21A:
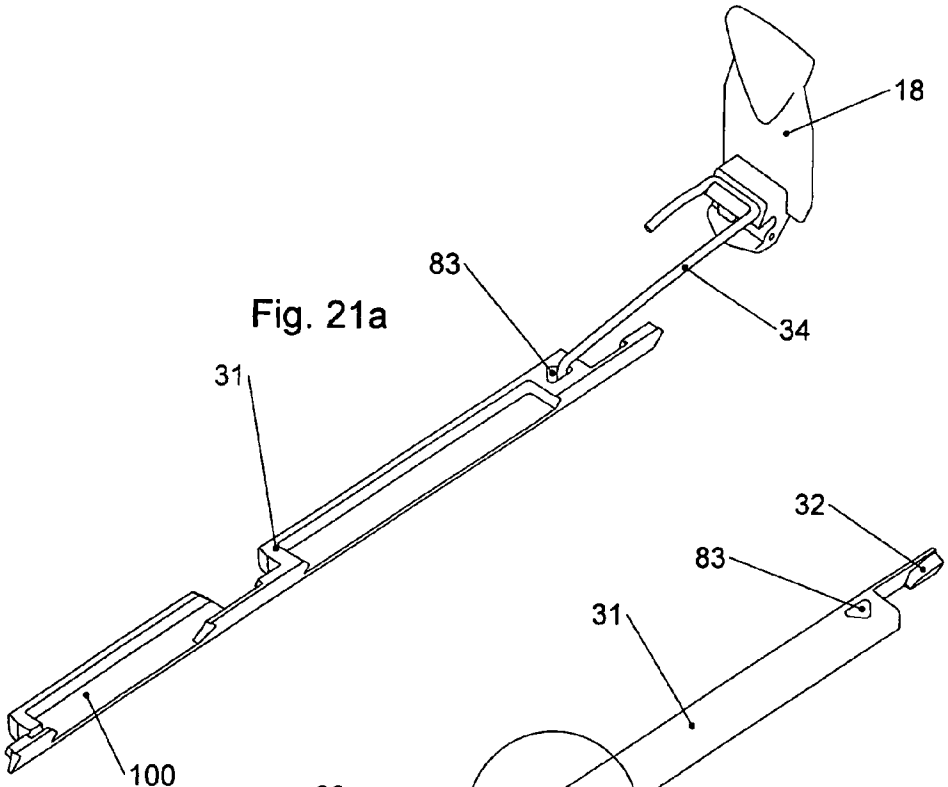
Figure 21B:
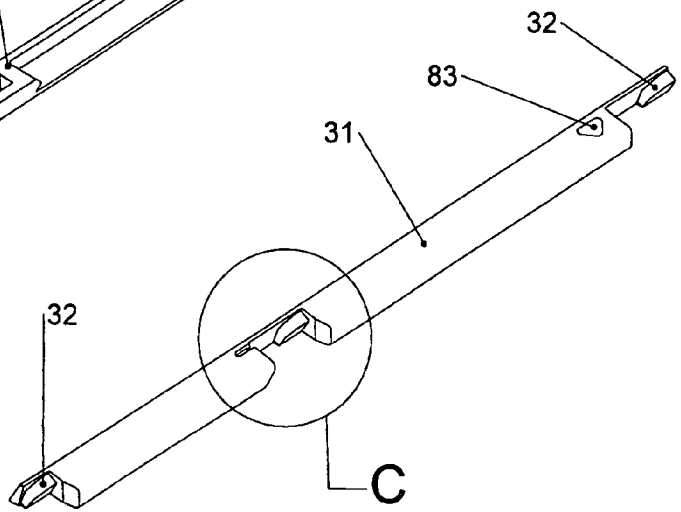
Figure 23B:
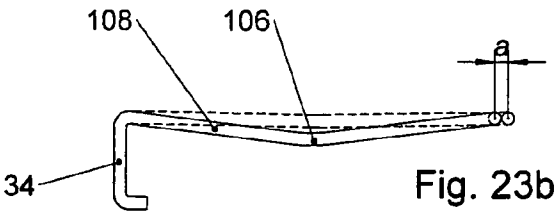
FIGS. 23*a*-23*c*. Three illustrative variants of a bent connecting element with spring elastic effective connecting shanks in accordance with embodiments of the present invention.
Figure 23C:
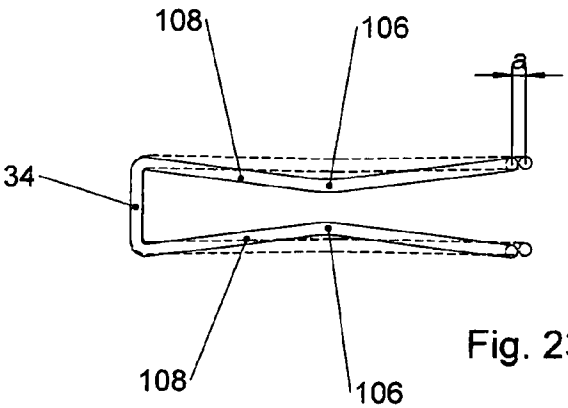
Figure 22A:
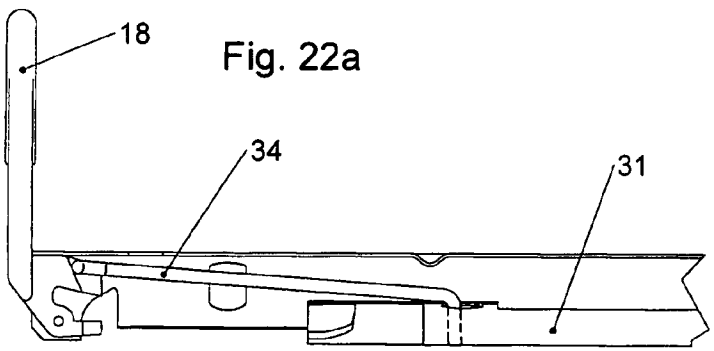
FIGS. 22*a* and 22*b*. A partial side view and a top view of the locking rod arrangement according to FIG. 21*a;*
Figure 22B:
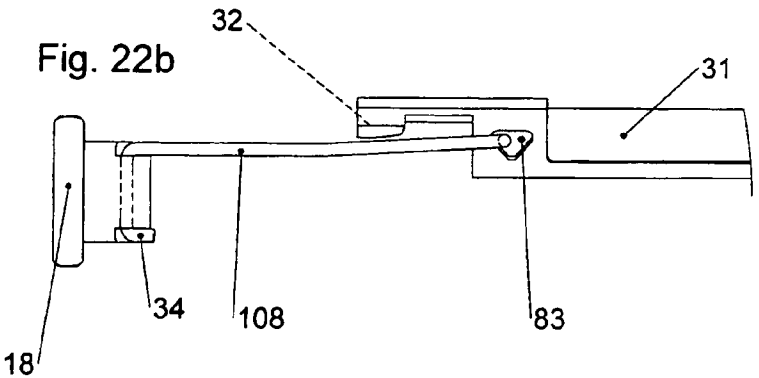
Figure 23A:
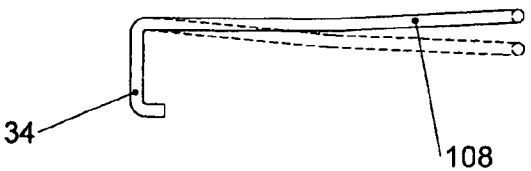
Figure 24A:
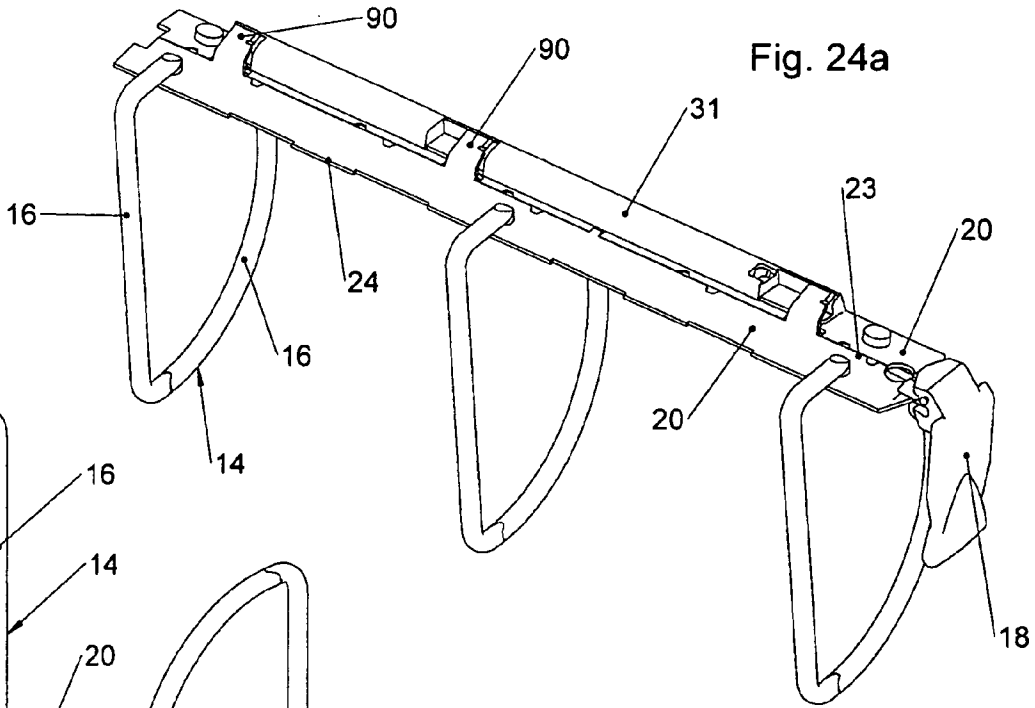
FIGS. 24*a*-24*d*. Perspective top and bottom views of a seventh embodiment of the ring binder mechanism (without housing) in the closed position and in the open position.
Figure 24B:
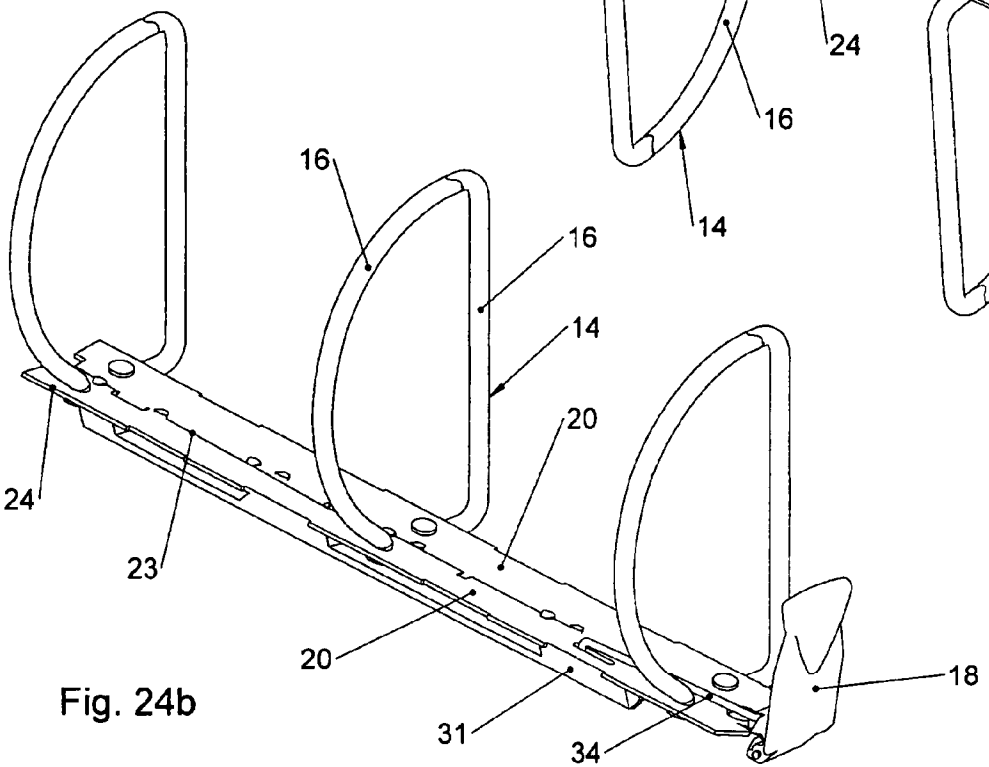
Figure 24C:
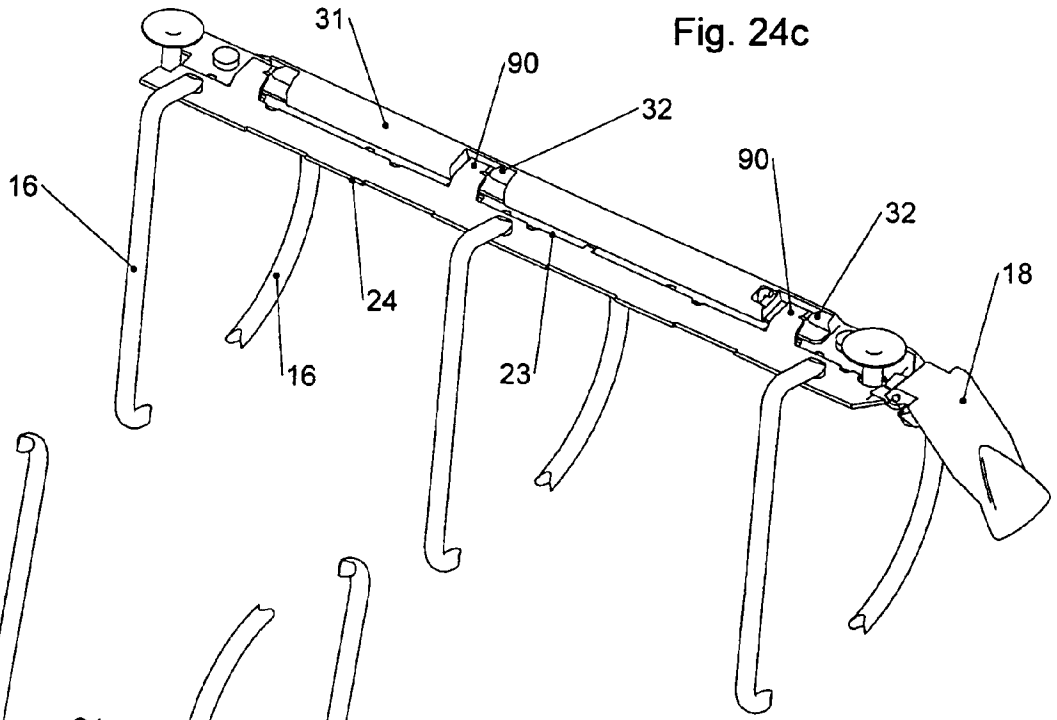
Figure 24D:
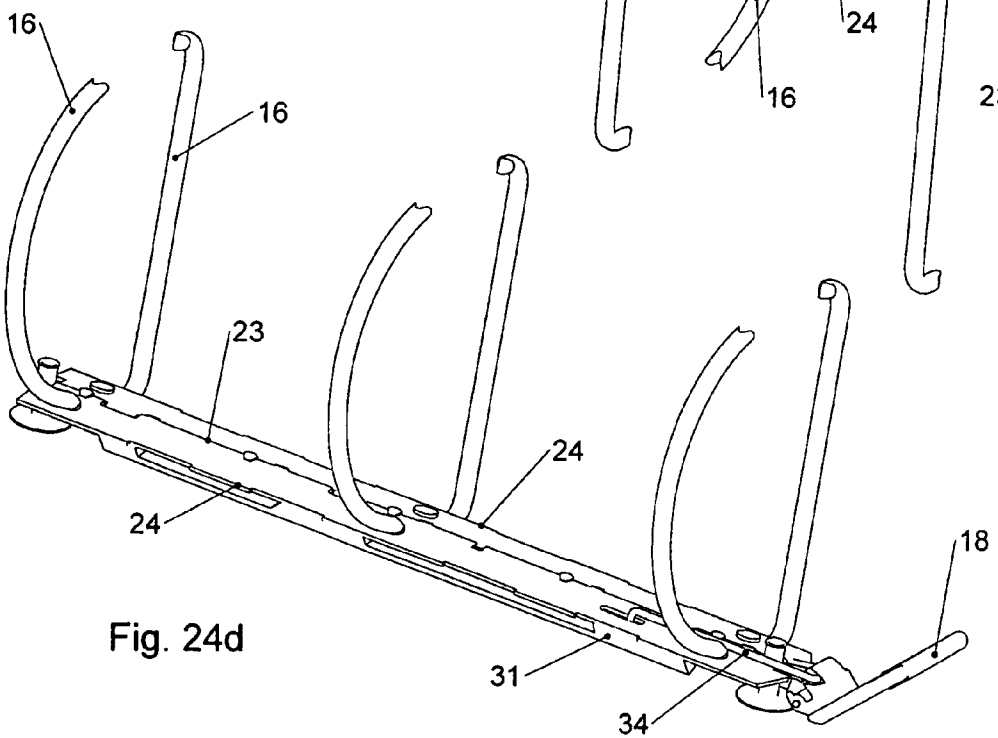
Figure 25C:
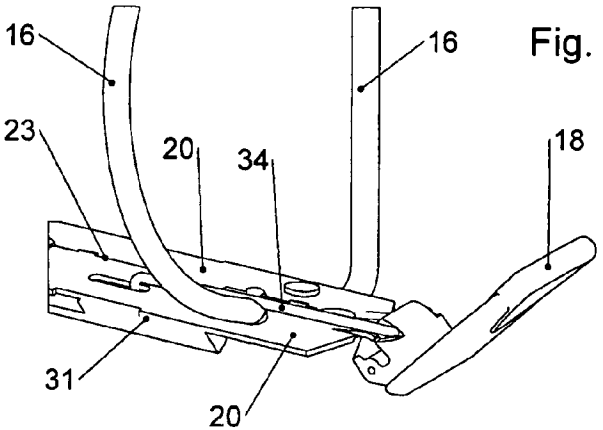
FIGS. 25*a*-25*d*. Enlarged partial views of the actuating element, connecting element, and locking rod of the ring binder mechanisms according to FIGS. 24*a*-24*d;*
Figure 25D:
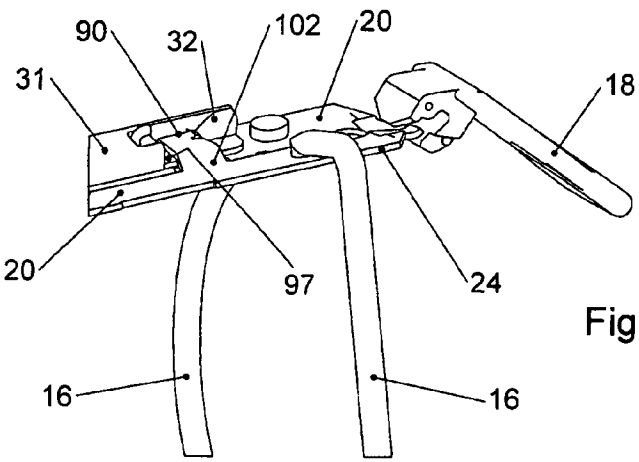
Figure 25A:
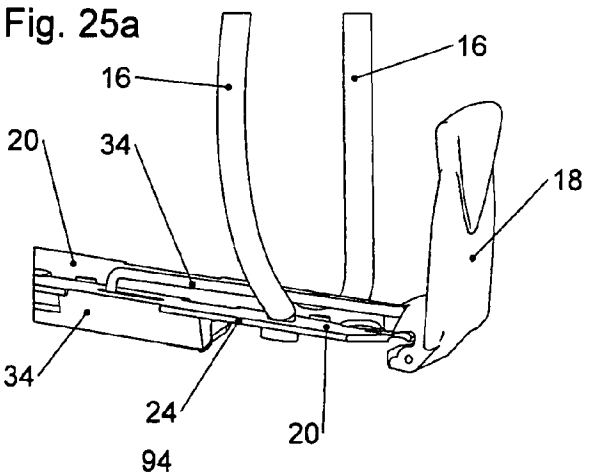
Figure 25B:
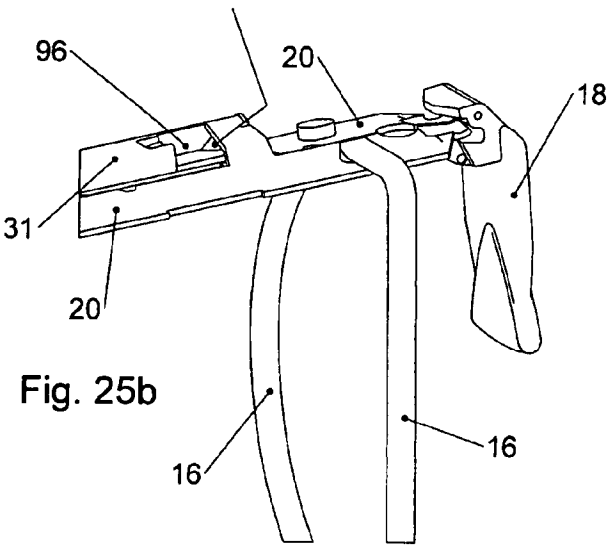
Figures 26A, 26B, 26C:
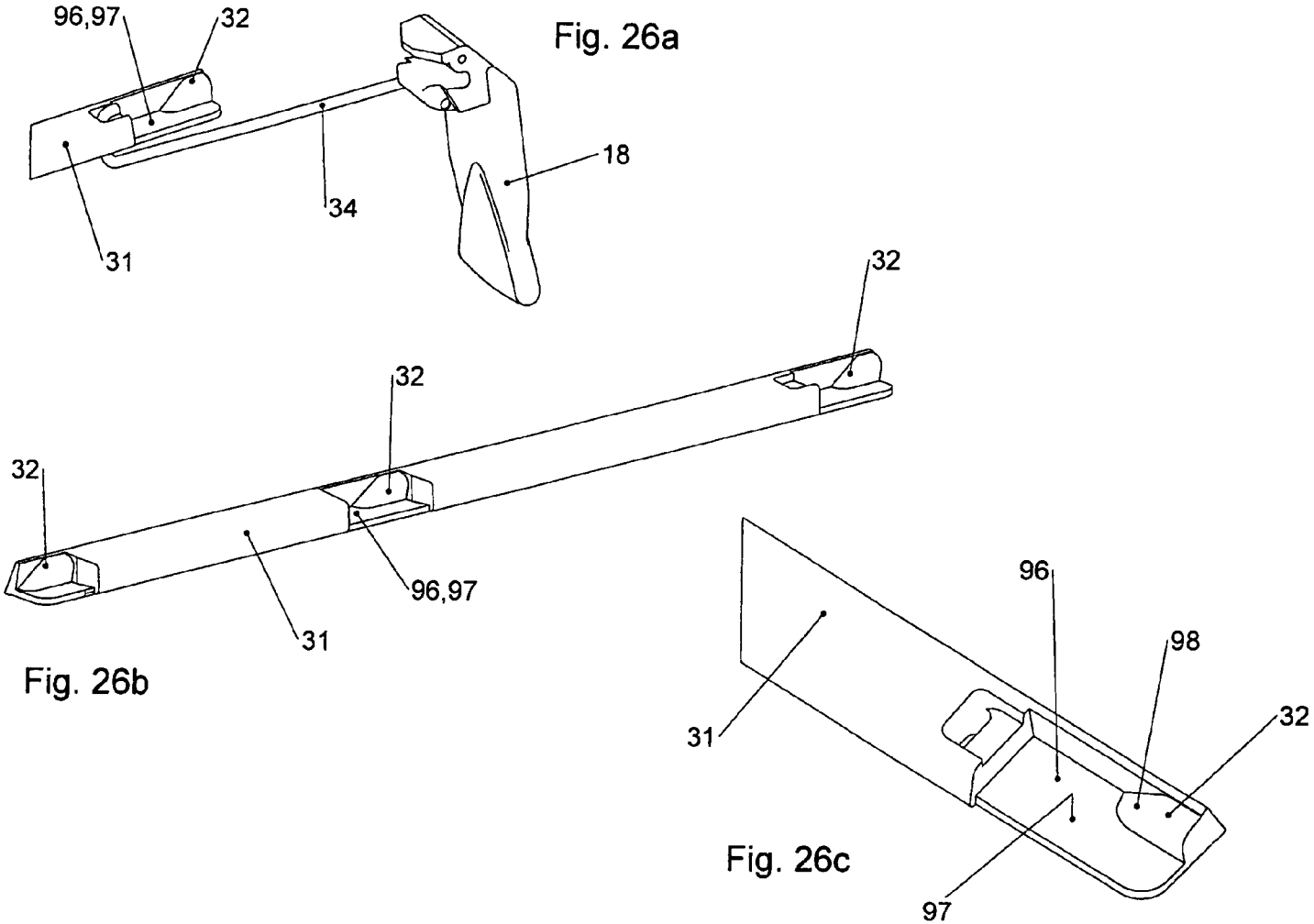
FIGS. 26*a*-26*c*. Partial perspective view of a locking rod with connecting element and actuating element, perspective view of the locking rod, and an enlarged partial view of the locking rod.

A special feature of the illustrative example according to FIGS. 16*a* through 27 is comprised therein, that the carrier rails 20 include at least two support elements 90, 92, pair-wise facing each other, which in the closed position of the half-rings 16 border a locking gap 94 (FIGS. 18*a* and 20*b*) for receiving a locking element 34 displaced in its closing or blocking position and supports itself with blockage of the pivot path of the carrier rails 20 on the locking elements 32 (FIG. 20*a*). Support elements 90 form a straight plate-like support strut, which at one of the carrier rails 20 projects sideways beyond its linkage axis side longitudinal edge 32 towards the other carrier rail 20 in the area of the support element 92 formed on the exterior surface of the other carrier rail, and borders an eccentric provided locking gap 94 of the associated, likewise eccentric provided locking element 32. The locking elements 32 are provided or formed on the locking rod 31, displaceable in the area of the other carrier rail 20, parallel to the linkage axis via the actuating element 18 (See FIGS. 17*a* through 18*b*). On its outer edge the locking rod 31 lies in the assembled condition slidingly against the adjacent housing flank 28. As can be seen particularly in FIGS. 17*b*, 18*b*, and 20*b*, in the open position, the support projections 90 lie directly against the other carrier rails 20 or indirectly via a locking rod floor 97 against the other carrier rails 20 to close the locking gap 94. The locking rod 31 includes an edge open recess 96 bordered on one side by the locking element 32. In the open position, the support projection 90 is received within recess 96 and in certain embodiments resting on locking rod floor 97 (FIG. 26*c*). As can be seen in particular from FIG. 18*b*, the locking elements 32 are provided with a displacement direction facing abutment slant or ramp 98 for the support projection 90.

Figures 16A, 16B:
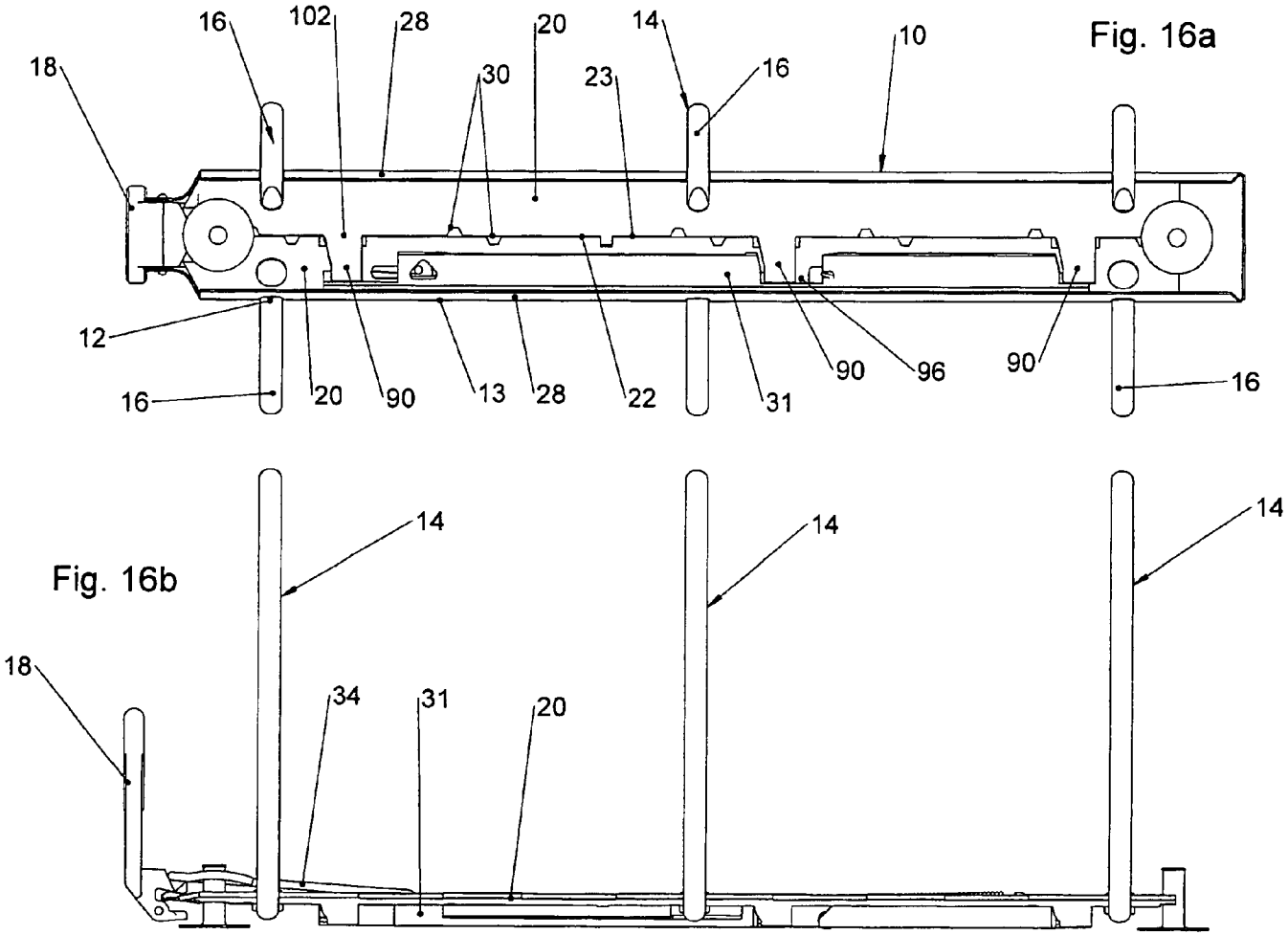
FIGS. 16*a*-16*d*. A bottom view, left and right longitudinal side views, and a top view of a sixth embodiment of the ring binder mechanism without the housing and in the closed position.
Figure 16C:
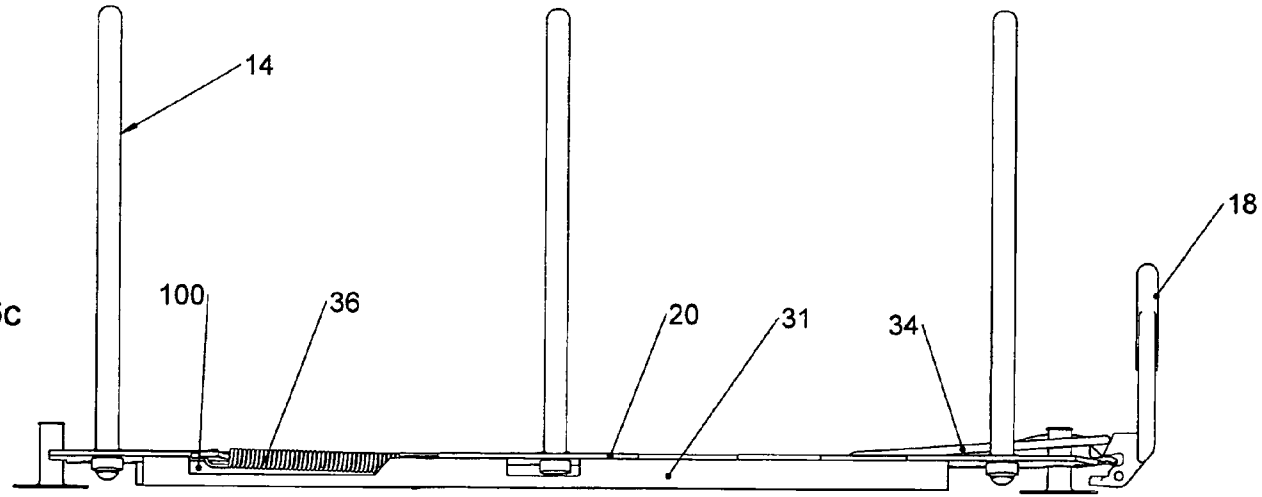
Figure 16D:
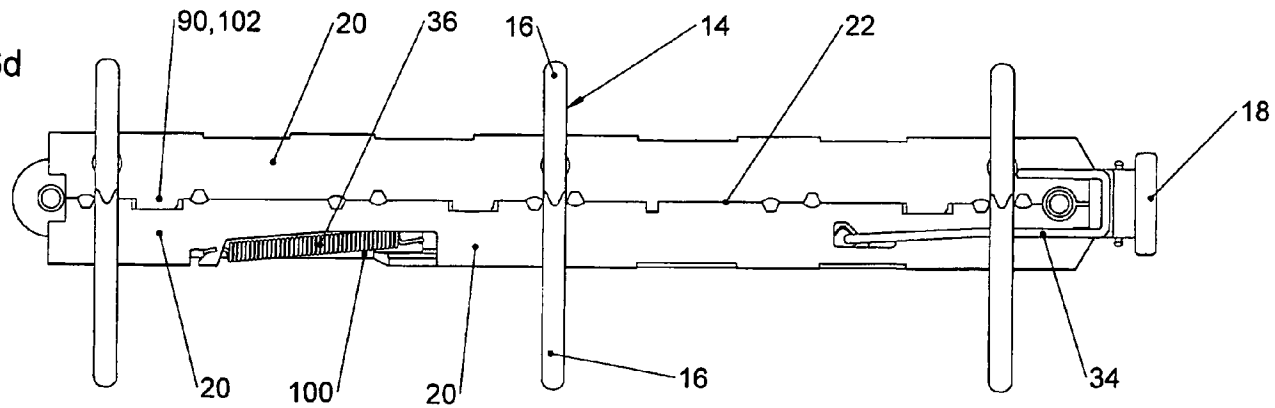
Figures 17A, 17B:
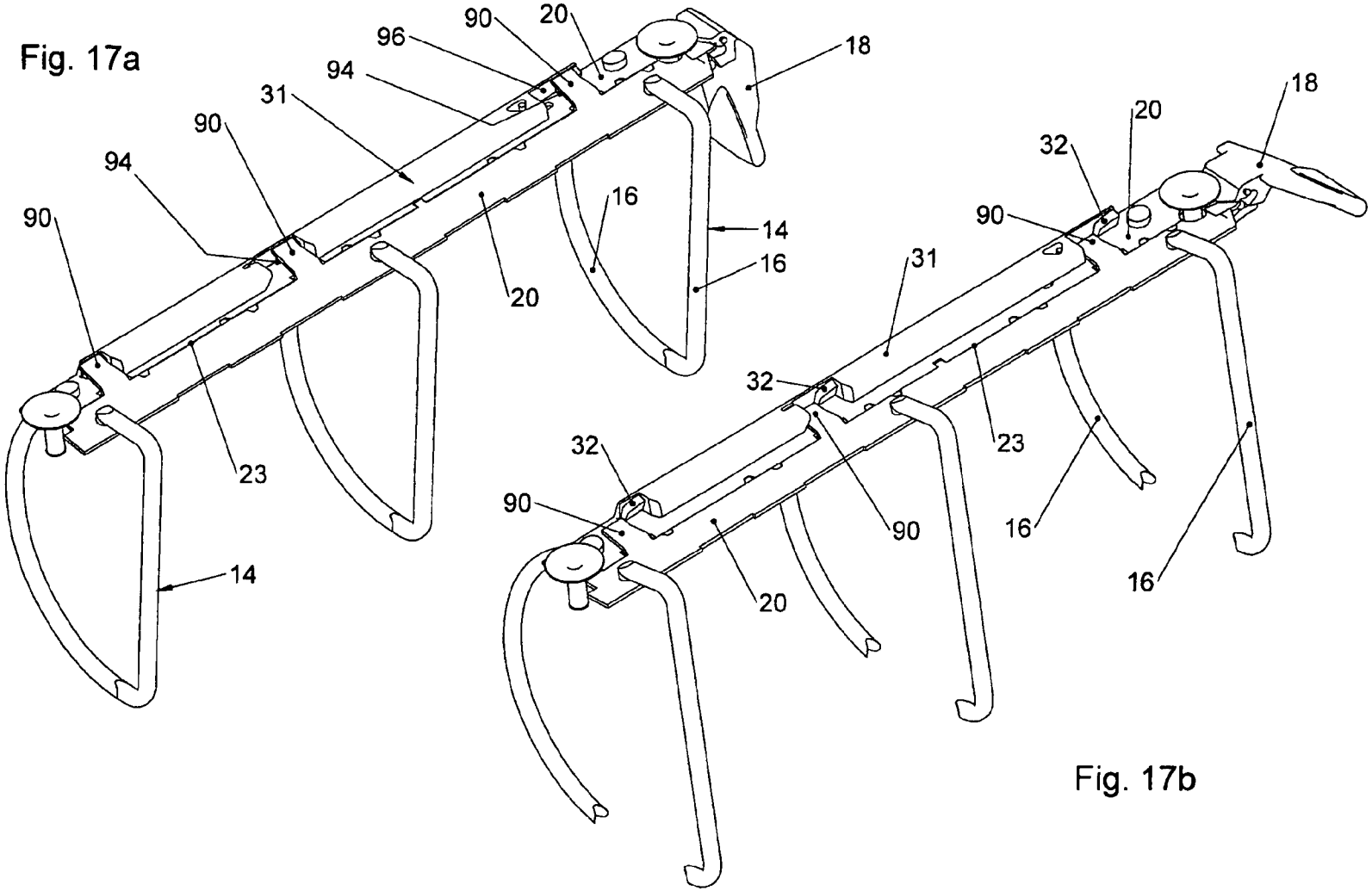
FIGS. 17*a* and 17*b*. Bottom perspective views of the ring binder mechanism according to FIGS. 16*a*-16*d* without the housing in the closed position and in the open position.
Figures 18A, 18B:
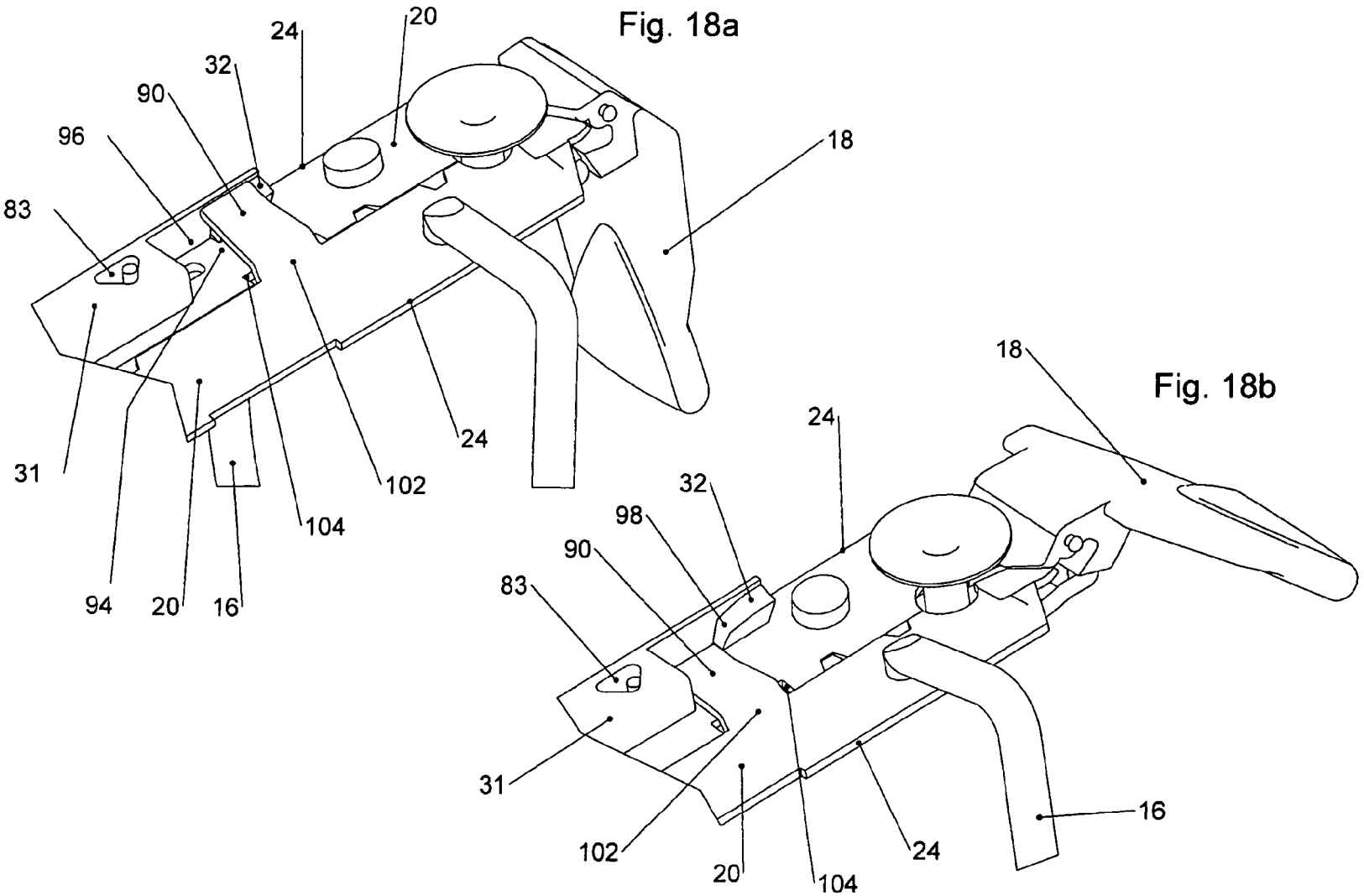
FIGS. 18*a* and 18*b*. Partial and enlarged bottom views of the mechanism according to FIGS. 17*a* and 17*b* respectively.

In the illustrative examples according to FIGS. 16*a* through 16*d* the locking rod is pretensioned with a closing spring 36 in the direction of the closed position. The closing spring 36 is therein in the form of a pull-spring, pretensioned between the locking rod 31 and one of the carrier rails 20. In the locking rod 31 there is a pocket-like open recess 100 facing the carrier rail 20 for receiving the closing spring 36 (FIGS. 16*a* and 16*d*). As can be seen from FIGS. 16*a* and 16*b* and FIGS. 20*a* and 20*b*, the support projection 90 forms a strip bent out of the carrier rail with its root or base 102 formed in the area of longitudinal edge 23, which in the area of its root or base 102 extends through an edge-open recess 104 of the other carrier rail.

Figure 27:
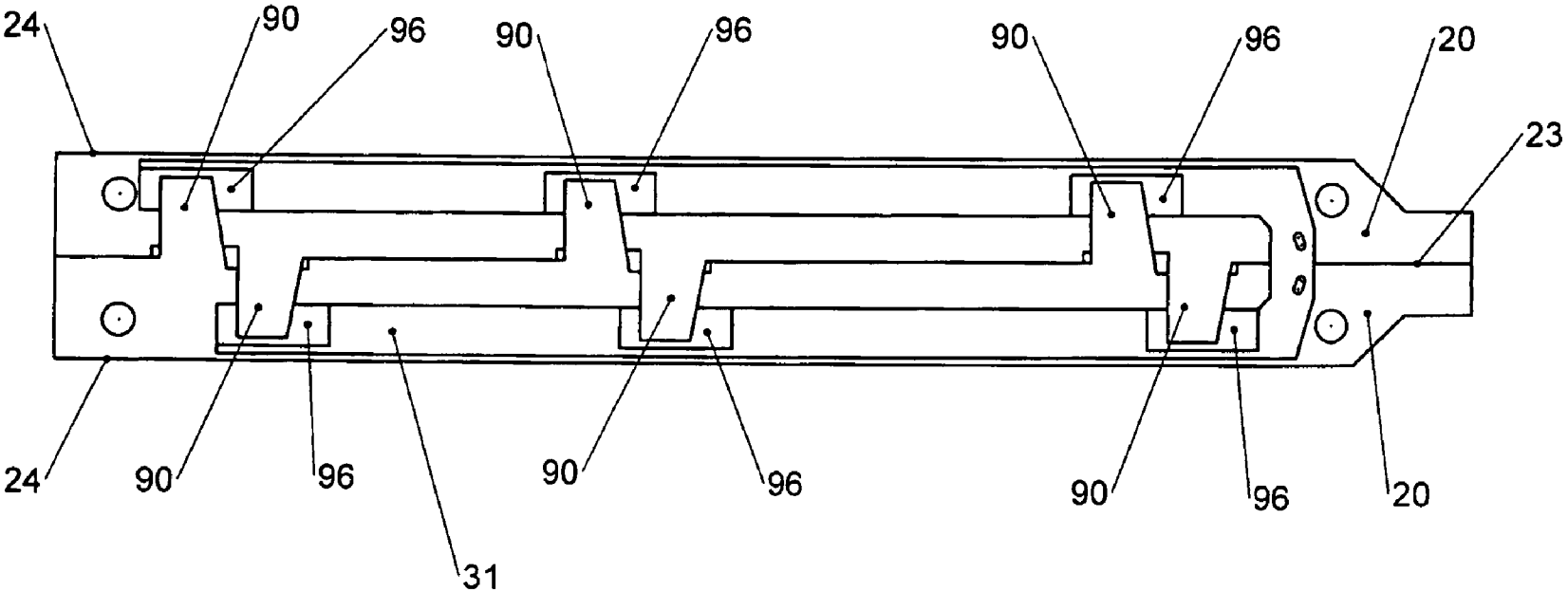
FIG. 27. A bottom view of an eighth illustrative embodiment of the ring binder mechanism of the present invention.

While only a total of three support or bearing strips 90 are provided on one of the carrier rails 20 in the illustrative embodiment shown in FIGS. 16*a* through 16*d*, in the case of the illustrative embodiment according to FIG. 27, three support projections 90 projecting towards the other carrier rail are provided on both carrier rails 20 respectively, wherein between the support projections 90 of the respective other carrier rail 20 a locking gap 94 (not shown) is formed for receiving one of the locking elements 32 (positioned below projections 90 in FIG. 27) in its closed or blocking position. The locking rod 31 is formed as an asymmetrical U-shaped open frame, on which the locking element 32 is provided eccentrically or off-centered adjacent the housing flanks 28. In the open position, locking rod 31 with the locking elements 32 are moved out of the locking gap 94 allowing support projections 90 to pivot into the open recess 96.

With the inventive support projection 90, it is accomplished that with a given housing the effective lever arm length, with which a carrier rail 20 supports itself via the associated locking element 32 against the support bearing on the other carrier rail 20 or on the housing flank 28, is substantially enlarged or increased, in fact nearly doubled. Therewith one achieves, relative to the width of the housing, a corresponding enlargement or increase of the closing moment at the half-rings 16.

In summary it can be concluded that the invention is concerned with a ring binder mechanism with a housing 10 with spring elastic bendable flanks 28 for two carrier rails 20, which on their longitudinal edges 23 facing each other lie against each other forming a linkage axis 22 and with their longitudinal edges 24 facing away from each other engage in bearing grooves 26 of the housing flanks 28. The carrier rails 20 exhibit at least two half-rings 16, in a defined longitudinal spacing from each other, rigidly connected with the carrier rails, pair-wise cooperating to form a ring 14, wherein the carrier rails 20 are limitedly pivotable relative to each other about the linkage axis 22, taking along the half-rings 16, between an open position and a closed position. Further, a locking rod 31 provided with at least one locking element 32 is pretensioned in the closed direction under the influence of a closing spring 36, movable parallel to a linkage axis 22 relative to the housing 10 and to the carrier rails 20 via an actuating element 18, which the locking element 32 in the closed position blocks the pivot path of the carrier rails 20 and in the open position frees the pivot path. In accordance with the invention, abutments or bearings are provided on the carrier rails 20 or on the housing flanks 28 for receiving locking forces, against which the locking rod 31 in the closed position having the at least one locking element 32 is supported.

From the foregoing it will be seen that this invention is one well adapted to attain all ends and objectives herein above set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A ring binder mechanism comprising:

a housing having a C or U-shaped cross section with spring elastic bendable flanks for receiving two carrier rails, wherein the carrier rails have an interior surface facing the housing and an exterior surface facing away from the housing and lie against each other with at least a portion of their inward facing longitudinal edges forming a linkage axis and at least a portion of their outward facing longitudinal edges engaging in bearing grooves in the housing flanks;

at least two half-rings rigidly connected with a carrier rail spaced apart by a defined longitudinal separation, said half-rings extending through openings in the housing wall and together forming a ring, wherein the carrier rails are limitedly pivotable relative to each other about the linkage axis taking along the half-rings between an open position and a closed position upon overcoming the influence of a spring force produced by the bending apart of the housing flanks;

at least one locking element provided on a locking rod positioned adjacent a portion of the exterior surface of the carrier rails and movable via an actuating element relative to the housing and the carrier rails, wherein said locking element blocks the pivot path of the carrier rails about the linkage axis in the closed position and is supported against at least one support bearing positioned on the exterior surface of the carrier rails and/or the housing flanks for receiving locking forces; and a connecting element provided between the actuating element and the locking rod made of a spring elastic or springing bendable material to render the actuating element free of play in the closed or locking position.

2. A ring binder mechanism according to claim 1, wherein the connecting element is a piece of wire with at least one connecting shank provided between the actuating element and the locking rod, wherein the at least one connecting shank comprises at least one elastic stretching bend responsive to the influence of a pull force.

3. A ring binder mechanism according to claim 1, wherein a connecting element is provided between the actuating element and the locking rod essentially in the form of a U or L-shaped bent piece of wire, which is bent into the shape of a hook on at least one shank end and is inserted into at least one opening in the locking rod.

4. A ring binder mechanism according to claim 3, wherein the at least one opening forms a guide slot diagonal to the displacement direction of the locking rod, and the at least one shank engages in the guide slot pretensioned spring elastically to thereby render the actuating element free of play in the closed position.

5. A ring binder mechanism comprising:

a housing having a C or U-shaped cross section with spring elastic bendable flanks for receiving two carrier rails, wherein the carrier rails lie against each other with their inward facing longitudinal edges forming a linkage axis and their outward facing longitudinal edges engage in bearing grooves in the housing flanks;

at least two half-rings rigidly connected with a carrier rail spaced apart by a defined longitudinal separation, said half-rings extending through openings in the housing wall and together forming a ring, wherein the carrier rails are limitedly pivotable relative to each other about the linkage axis taking along the half-rings between an open position and a closed position upon overcoming the influence of a spring force produced by the bending apart of the housing flanks;

at least one locking rod movable via an actuating element relative to the housing and the carrier rails, carrying at least two locking elements spaced apart from each other and pretensioned in the direction of the closed position under the influence of at least one closing spring, wherein the locking elements in the closed position block the pivot path of the carrier rails about the linkage axis and are supported by at least one support bearing for receiving of locking forces, and in the opened position the pivot path of the carrier rails is unblocked; and a connecting element provided between the actuating element and the locking rod essentially in the form of a U or L-shaped bent piece of wire having at least one shank bent into the shape of a hook on at least one shank end that is inserted into at least one opening in the locking rod, wherein the at least one opening forms a guide slot diagonal to the displacement direction of the locking rod, and the at least one shank engages spring elastic pretensioned in the guide slot and thereby renders the actuating element free of play in the closed position.

6. A ring binder mechanism comprising:

a housing having a C or U-shaped cross section with spring elastic bendable flanks for receiving two carrier rails, wherein the carrier rails lie against each other with at least a portion of their inward facing longitudinal edges forming a linkage axis and at least a portion of their outward facing longitudinal edges engaging in bearing grooves in the housing flanks;

at least two half-rings rigidly connected with a carrier rail spaced apart by a defined longitudinal separation, said half-rings extending through openings in the housing wall and together forming a ring, wherein the carrier rails are limitedly pivotable relative to each other about the linkage axis taking along the half-rings between an open position and a closed position upon overcoming the influence of a spring force produced by the bending apart of the housing flanks;

at least one locking element provided on a locking rod movable via an actuating element relative to the housing and the carrier rails, wherein said locking element blocks the pivot path of the carrier rails about the linkage axis in the closed position and is supported against at least one support bearing for receiving locking forces;

and a connecting element provided between the actuating element and the locking rod made of a spring elastic or springing bendable material, said connecting element being essentially in the form of a U or L-shaped bent piece of wire, which is bent into the shape of a hook on at least one shank end and is inserted into at least one opening in the locking rod that forms a guide slot diagonal to the displacement direction of the locking rod, and the at least one shank end engages in the guide slot pretensioned spring elastically to thereby render the actuating element free of play in the closed position.

* * * * *